US010668356B2

(12) United States Patent
Bangera et al.

(10) Patent No.: US 10,668,356 B2
(45) Date of Patent: Jun. 2, 2020

(54) PROTECTIVE GARMENT SYSTEMS FOR PROTECTING AN INDIVIDUAL AND METHODS OF USING THE SAME

(71) Applicant: Elwha LLC, Bellevue, WA (US)

(72) Inventors: Mahalaxmi Gita Bangera, Renton, WA (US); Jesse R. Cheatham, III, Seattle, WA (US); Hon Wah Chin, Palo Alto, CA (US); Roderick A. Hyde, Redmond, WA (US); Muriel Y. Ishikawa, Livermore, CA (US); Jordin T. Kare, San Jose, CA (US); Eric C. Leuthardt, St. Louis, MO (US); Elizabeth A. Sweeney, Seattle, WA (US)

(73) Assignee: ELWHA LLC, Bellevue, WA (US)

( * ) Notice: Subject to any disclaimer, the term of this patent is extended or adjusted under 35 U.S.C. 154(b) by 680 days.

(21) Appl. No.: 15/224,178

(22) Filed: Jul. 29, 2016

(65) Prior Publication Data

US 2018/0027909 A1 Feb. 1, 2018

(51) Int. Cl.

| | |
|---|---|
| ***A63B 71/08*** | (2006.01) |
| ***A41D 31/28*** | (2019.01) |
| ***A41D 13/018*** | (2006.01) |
| *A41D 1/00* | (2018.01) |

(52) U.S. Cl.
CPC ..... *A63B 71/081* (2013.01); *A41D 13/018* (2013.01); *A41D 31/28* (2019.02); *A41D 1/002* (2013.01)

(58) Field of Classification Search
CPC .... A41D 13/015; A41D 13/018; A41D 1/002; A41D 31/28; A63B 71/081
USPC ..... 2/455, 2.5
See application file for complete search history.

(56) References Cited

U.S. PATENT DOCUMENTS

| | | | | |
|---|---|---|---|---|
| 5,218,954 | A | 6/1993 | van Bemmelen | |
| 5,771,489 | A * | 6/1998 | Snedeker | A41D 13/0518 2/2.5 |
| 6,969,548 | B1 * | 11/2005 | Goldfine | B29C 44/1214 428/159 |
| 9,232,825 | B2 * | 1/2016 | Bencini | A41D 13/015 |
| 2015/0297973 | A1 * | 10/2015 | Beers | A63B 71/12 2/461 |
| 2017/0360122 | A1 * | 12/2017 | Chin | A41D 1/002 |
| 2018/0027893 | A1 * | 2/2018 | Bangera | A41D 13/015 |
| 2018/0027894 | A1 * | 2/2018 | Bangera | A41D 13/018 |

* cited by examiner

*Primary Examiner* — Katherine M Moran
(74) *Attorney, Agent, or Firm* — Dorsey & Whitney LLP

(57) ABSTRACT

Embodiments disclosed herein are directed to protective garments and systems that include a protective garment for protecting one or more body regions of an individual wearing the protective garment.

39 Claims, 12 Drawing Sheets

PROTECTIVE GARMENT SYSTEMS FOR PROTECTING AN INDIVIDUAL AND METHODS OF USING THE SAME

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

None.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

BACKGROUND

Impact injuries are sustained from impacts of objects against an individual and impact of the individual against objects. Impact injuries include blunt force traumas, punctures, concussion, broken bones, damaged joints, and other medical conditions. Equipment for prevention of impact injuries has existed for many centuries in many forms, including medieval armor and ancient Egyptian helmets.

Prevention of impact injuries has led to the development of modern safety equipment, such as hardhats, batting helmets, football pads, knee-braces, and body armor such as bullet proof vests, etc. Some safety equipment useful for preventing impact injuries is bulky, cumbersome, heavy, and can limit movement. For example, football pads can limit movement and tend to be bulky. Knee or other joint braces can unduly limit range of motion. Body armor tends to be bulky, heavy, and may limit range of motion in some cases.

SUMMARY

Embodiments disclosed herein are directed to protective garments and systems that include such a protective garment for protecting one or more body regions of an individual wearing the protective garment. In particular, for example, the protective garments or the systems can be reconfigured from a first, undeployed configuration to a second, deployed configuration to protect the individual from an impact. In an embodiment, the protective garment can have more flexibility in the undeployed configuration than in the deployed configuration.

In an embodiment, a protective garment system is disclosed. The protective garment system includes at least one surface that is at least one of conformed or conformable to one or more body regions of an individual. The protective garment system also includes a plurality of shield segments positioned adjacent to the at least one surface and at least one resilient member that secures at least one of the plurality of shield segments near the at least one surface. The at least one resilient member configured to elastically extend to enable the at least one of the plurality of shield segments to move from a first position to a second position responsive to one or more forces applied thereto. The at least one resilient member is also configured to contract to return the at least one of the plurality of shield segments from the second position to the first position.

In an embodiment, a protective garment system is disclosed. The protective garment system includes a substrate that is at least one of conformed or conformable to one or more body regions of an individual and a plurality of shield segments positioned adjacent to the substrate. The protective garment system also includes an activation mechanism operably coupled to one or more shield segments of the plurality of shield segments. The activation mechanism is configured to selectively move the one or more shield segments from a first position to a second position responsive to a first signal.

In an embodiment, a protective garment system is disclosed. The protective garment system includes a substrate that is conformed or conformable to one or more body regions of an individual and a plurality of shield segments positioned adjacent to the substrate. At least one of the plurality of shield segments is movably coupled to the substrate. The protective garment system also includes one or more inhibitor elements configured to inhibit movement of one or more of the plurality of shield segments.

In an embodiment, a method of protecting one or more body parts of an individual is disclosed. The method includes one or more protective garments contacting the one or more body parts of the individual. Each of the one or more protective garments includes a surface that is at least one of conformed or conformable to one or more body regions of an individual, a plurality of shield segments, and at least one resilient member. The at least one of the plurality of shield segments is secured adjacent to the surface by at least one of the plurality of resilient members. Furthermore, the at least one of the plurality of resilient members is configured to elastically deform and extend from a first length to a second length, thereby allowing the at least one of the plurality of shield segments to move from a first position to a second position responsive to one or more forces applied thereto. The at least one of the plurality of resilient members is also configured to contract from the second length to the first length to return the at least one of the plurality of shield segments from the second position to the first position. The method also includes receiving the one or more forces at the at least one of the plurality of shield segments.

In an embodiment, a method of protecting one or more body parts of an individual is disclosed. A method of protecting one or more body parts of an individual. The method includes one or more protective garments contacting the one or more body parts of the individual. Each of the one or more protective garments includes a substrate that is at least one of conformed or conformable to one or more body regions of an individual, a plurality of shield segments positioned adjacent to the substrate, and an activation mechanism operably coupled to one or more shield segments of the plurality of shield segments. The method also includes activation mechanism directing the one or more shield segments to move between a first position and a second position. Moreover, the method includes the one or more shield segments moving from the first position to the second position responsive to a first signal.

In an embodiment, a protective garment system for protecting one or more body parts of at least one individual is disclosed. The protective garment system includes a plurality of protective garments. Each of the plurality of protective garments including a substrate that is at least one of conformed or conformable to one or more body regions of an individual, a plurality of shield segments positioned adjacent to the substrate, and an activation mechanism operably coupled to one or more shield segments of the plurality of shield segments, and the activation mechanism configured to selectively move the one or more shield segments from a first position to a second position responsive to a first signal. The system further includes one or more sensors configured to sense at least one of a potential impact or an actual impact with at least one of the plurality of garments, and at least one controller operably coupled to the one or more sensors and the activation mechanism.

Features from any of the disclosed embodiments can be used in combination with one another, without limitation. In addition, other features and advantages of the present disclosure will become apparent to those of ordinary skill in the art through consideration of the following detailed description and the accompanying drawings.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
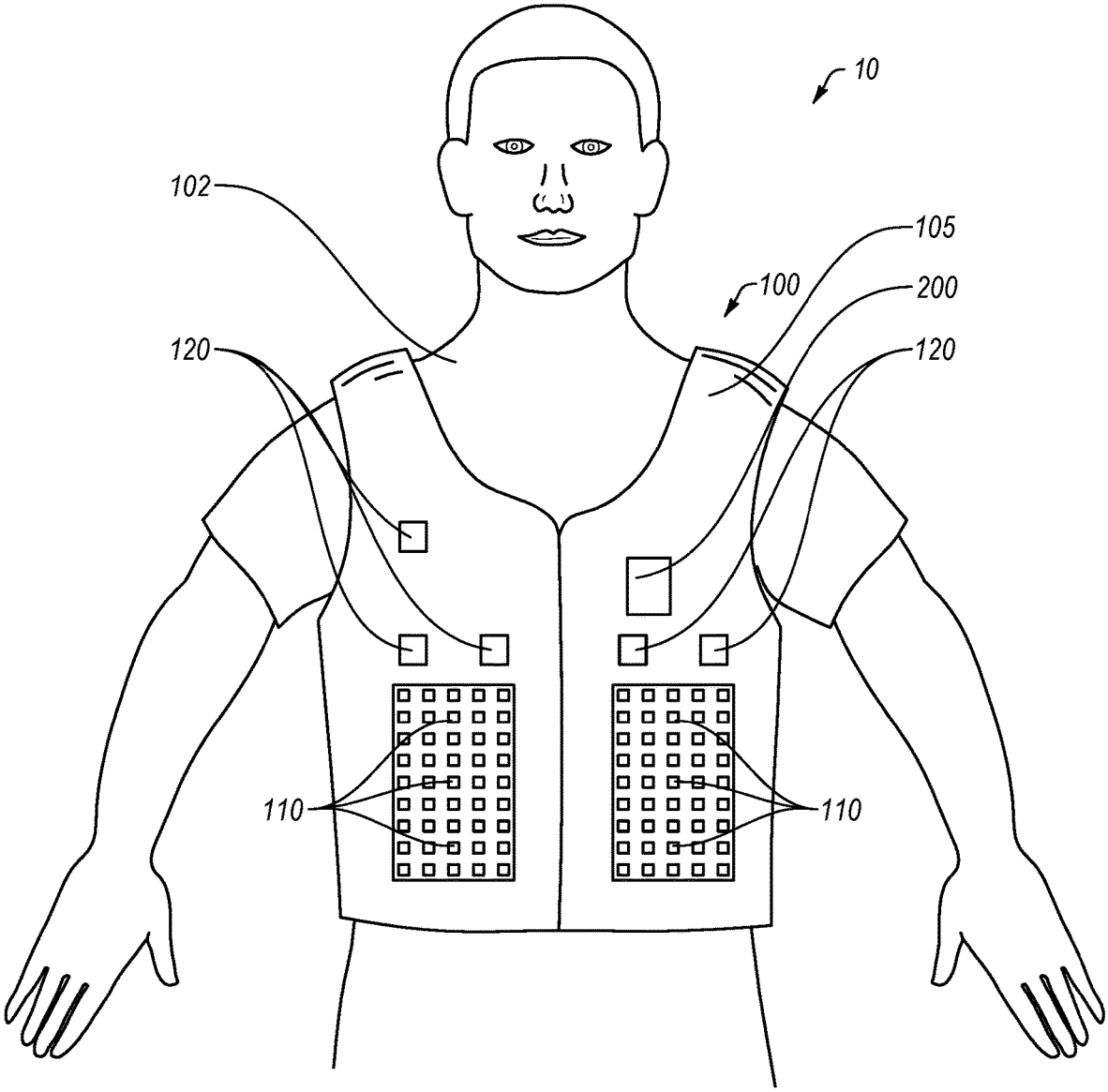
FIG. 1 is a schematic of a protective garment system 10 for protecting an individual 102 from injuries, according to an embodiment.

Embodiments disclosed herein are directed to protective garments and protective garment systems that include such a protective garment for protecting one or more body regions of an individual (e.g., human or non-human animal) wearing the protective garment. In particular, for example, the protective garments or the protective garment systems can be reconfigured from a first, undeployed configuration to a second, deployed configuration to protect the individual from an impact. In an embodiment, the protective garment can have more flexibility in the undeployed configuration than in the deployed configuration.

In an embodiment, the individual wearing the protective garment can have a substantially full range of motion of the various body regions protected by the protective garment. For example, in the undeployed configuration, the protective garment can bend, twist, or otherwise deform as the individual moves the body regions protected or covered by the garment. Moreover, in an embodiment, the protective garment can be shaped or contoured to the shape(s) of the body regions of the individual (e.g., such that an inside surface or face of the protective garment can be substantially in contact with the skin of the individual or generally follow the surface of the skin).

In an embodiment, the protective garment can protect the covered portions of the individual from an impact by distributing the force(s) produced by the impact or by deflecting the force(s) applied by the impact onto the protective garment. For example, the protective garment can include multiple shield elements or segments that can move relative to the protected body regions of the individual. The movement of the shield segments can be produced at least in part responsive to an impact or an impending impact.

For example, the protective garment can include athletic apparel (e.g., football jersey, hockey jersey, etc.) or gear (e.g., rib guard or hockey girdle) and the shield segments can be positioned on the protective garment or gear to at least partially protect an individual wearing the protective garment or gear from injuries that can occur during an athletic event. In another example, the protective garment or gear can be apparel that is worn during a potentially hazardous activity. The hazardous activity can be an activity that includes projectiles or other actual or potential impact sources. In particular, the protective garment can be at least a portion of military apparel, policeman's uniform, fireman's uniform, first responder's uniform, construction worker's apparel, paintball apparel, ski apparel, motorcycle safety apparel, tactical gear, or other similar items.

Generally, the shield segments can include any number of suitable materials. In an embodiment, the shield segments can include a suitably rigid or resilient material (e.g., plastic, metal, etc.) that can suitably absorb and redistribute impact force (e.g., without plastic deformation or failure). Moreover, multiple shield segments can connect or interconnect together, such that the impact force applied to one or more shield segments can be distributed onto additional shield segments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments can be utilized, and other changes can be made, without departing from the spirit or scope of the subject matter presented here.

FIG. 1 is a schematic of a protective garment system 10 for protecting an individual 102 from injuries such as impacts, puncture wounds, concussion, etc., according to an embodiment. The protective garment system 10 includes a protective garment 100 having one or more protective members or shield segments 110, and one or more sensors 120. The protective garment system 10 further includes at least one controller 200 that can be integrated with the protective garment 100 in some embodiments or separate from the protective garment 100 in other embodiments. At least one of the one or more shield segments 110, one or more sensors 120, and at least one controller 200 can be supported by one or more components of the protective garment 100, such as a substrate, gear, surface, or other supportive member 105. The protective garment 100 can be worn by the individual 102.

The protective garment 100 can change from a first state (e.g., an undeployed configuration) to a second state (e.g., deployed configuration) responsive to direction from the at least one controller 200. In the first state, the shield segments 110 can be configured or arranged to provide flexibility or freedom of movement to a body part of the individual (e.g., leg, abdomen, etc.) or a portion of the protective garment 100 (e.g., sleeve, waist, abdominal region, etc.) adjacent thereto. In the second state, the shield segments 110 can be configured or arranged to provide relative inflexibility or rigidity to one or more body parts of the individual 102 and portion of the protective garment 100 adjacent thereto for enhanced protection of the individual 102 from injuries. In an embodiment, the first state may provide less relative rigidity than the second state. The relative rigidity of the second state may provide one or more of impact resistance, structural support, or force-dampening effects to a body part of the individual 102 or to the protective garment 100.

The one or more sensors 120 can sense at least one of a potential impact or an actual impact, as described in detail below. For example, the potential impact source or actual impact source can be another individual, another athlete (e.g., a football player), a projectile (e.g., a ball, falling debris), a surface (e.g., a road, a playing surface, a fence), etc. The sensed potential impact or actual impact can be relayed from the one or more sensors 120 to the controller 200, as described in detail below. The controller 200 is configured to selectively direct one or more of the shield segments 110 to alter from the first state to the second state, vice versa, or some intermediate state therebetween, responsive to the sensed impact or potential impact, as described in detail below. In an embodiment, each shield segment 110 includes at least one dedicated sensor and at least one dedicated controller that operates responsive to the at least one dedicated sensor.

Generally, the protective garment 100 can be worn by the individual 102 on any body portion thereof for protection from impact. In the illustrated embodiment, the protective garment 100 can at least partially surround the torso of the individual 102. In an embodiment, the protective garment 100 can protect at least a portion of the torso and one or more internal organs of the individual 102 from an impact (e.g., spleen, kidneys, liver, etc.). As mentioned above, the protective garment 100 can include multiple shield segments, such as the shield segments 110, which can move relative to one another or relative to one or more body regions protected by the protective garment 100.

Generally, the supportive member 105 of the protective garment 100 can include at least one surface (e.g., a continuous or at least partially interrupted surface) that can at least approximately or substantially conform to one or more body regions of the individual 102, such as the skin at one or more body regions of the individual 102. For example, the supportive member 105 of the protective garment 100 can be preconfigured (e.g., bent, molded, or otherwise shaped) to conform to one or more body regions of the individual 102 (e.g., specifically be designed to conform to one or more body regions of a specific individual), such that an inner surface of the protective garment 100 is in direct or indirect contact with the skin of the protective garment 100 at the protected body regions thereof. Alternatively or additionally, the supportive member 105 of the protective garment 100 can be suitably flexible, such as to conform to one or more body regions of the individual 102 protected by the protective garment 100 (e.g., when the protective garment 100 is in an undeployed configuration or when the protective garment 100 is in the deployed configuration).

For example, the supportive member 105 can include a garment, such as athletic apparel or gear (e.g., football jersey, hockey girdle, etc.) and the shield segments 110 can be positioned on the supportive member 105 to at least partially protect an individual wearing the supportive member 105 from injuries that can occur during an athletic event. In another example, the supportive member 105 can include a garment, apparel, or gear that is worn during a potentially hazardous activity. The hazardous activity can include an activity that includes projectiles or other actual or potential impact sources. In particular, the supportive member 105 can be at least a portion of military apparel, policeman's uniform, fireman's uniform, first responder's uniform, construction worker's apparel, paintball apparel, motorcycle safety apparel, tactical gear, or other similar apparel. In some embodiments, the supportive member 105 can include an article of clothing or apparel. In some embodiments, the supportive member 105 can include protective gear (e.g., a rib guard, a helmet, or a hockey girdle). In some embodiments, the supportive member 105 can include supportive gear or apparel such as a brace or athletic supporter.

In an embodiment, when the protective garment 100 is in an undeployed configuration, the shield segments 110 of the protective garment 100 can be suitably free to move relative to one another in a manner that allows the protective garment 100 to bend, flex, or otherwise deform corresponding to bending, flexing, or otherwise deforming of the body regions protected by the protective garment 100. For example, the shield segments 110 can be movably secured to a substrate or other supportive member 105, a portion of which can define or form the at least one surface of the protective garment 100 that at least partially conforms to the protected body regions of the individual 102.

Generally, the substrate or other supportive member 105 of the protective garment 100 can include any number of suitable materials. For example, any material that can be substantially elastic or inelastic. For example, the supportive member 105 can include stretchable or resilient materials, such as rubber, steel (e.g., spring steel), elastane, etc. Alternatively or additionally, substrate can include cloth (e.g., cotton, nylon, polyester, etc.) that can, for example, be substantially non-stretchable.

In an embodiment, the protective garment 100 can be operably coupled to the controller 200 (e.g., a protective garment system can include the controller 200 operably coupled to the protective garment 100). For example, the shield segments 110 can be movable one relative to another or relative to the protected body portion of the individual 102. As described below in more detail, movement of the shield segments can be at least partially actuated responsive to one or more signals received from the controller 200. For example, the protective garment 100 can include any number of suitable actuation or activation mechanisms that can produce relative movement among the shield segments 110 of the protective garment 100 responsive to one or more signals received from the controller 200.

In an embodiment, the controller 200 can receive one or more inputs that the controller 200 can correlate to an impact or impending impact onto the protective garment 100 and the individual 102 wearing the protective garment 100. In an embodiment, the controller 200 can include an interface (e.g., 110 interface) and can receive one or more inputs via such interface. For example, the interface of the controller 200 can be operably coupled to or integrated with control electrical circuitry of the controller 200.

In an embodiment, the individual 102 can send or input one or more inputs into the controller 200, which can be correlated by the controller 200 with an impact or a potential impact and, responsive to which, the controller 200 can generate one or more signals that can be sent to the activation mechanism of the protective garment 100, thereby moving the shield segments 110 of the protective garment 100 relative to one another and relative to the individual 102.

The input can be sent via any suitable input device (e.g., the controller 200 can include or can be connected to an interface configured to communicate with one or more of a user, a computing device, a tablet, a mobile computing device (e.g., smart phone), or a remote control). For example, a personal electronic device (e.g., personal electronic device of the individual 102, such as a smart phone) can be operably coupled at the interface of the controller 200 and can send one or more signals or inputs to the controller 200. Additionally or alternatively, one or more buttons, a keyboard, or any other suitable device can be operably coupled to the controller 200 (e.g., at the interface thereof) and can send one or more signals thereto. Such signals can be processed or correlated by the controller 200 to one or more signals to move one or more of the shield segments (e.g., to signals that can be sent to activation mechanism(s)).

Alternatively or additionally, in an embodiment, the controller 200 can receive input from one or more sensors, such as sensors 120. For example, the sensors 120 can be operably coupled to the control circuitry of the controller 200 (e.g., at the I/O interface of the controller 200). In an embodiment, at least one sensor (e.g., at least one sensor 120) can be positioned on, near, or integrated with one or more portions of the protective garment 100.

Suitable sensors (e.g., sensors 120) can vary from one embodiment to the next. For example, the sensors 120 can be configured to sense at least one of a potential or actual impact. For example, the one more sensors 120 include one or more of an accelerometer, a proximity sensor, an optical sensor, a topography sensor, a thermal sensor, a force sensor, an acoustic sensor, among others. For example, the potential impact source or actual impact source can be another individual, another athlete (e.g., a football player), a projectile (e.g., a ball, falling debris), a surface (e.g., a road, a playing surface), etc.

In an embodiment, the sensors 120 can include one or more accelerometers configured to sense the movement of the individual, the potential impact source, or the actual impact source. In an embodiment, the sensors 120 can include one or more proximity sensors configured to sense one or more characteristics of the individual, the potential impact source, or the actual impact source. The one or more proximity sensors can include an infrared sensor, sonar, a laser rangefinder, a micro-impulse radar, an inductive sensor, a capacitive sensor, a photoelectric sensor, an ultrasonic sensor, etc. In an embodiment, the sensors 120 can include one or more optical sensors configured to sense one or more characteristics of the individual, the potential impact source, or the actual impact source. The one or more optical sensors can include an active-pixel sensor, light-emitting diodes that are reversed biased, a transducer, etc. For example, the optical sensors can be configured to sense a geometry of the potential or actual impact source. In an embodiment, the sensors 120 can include one or more topography sensors configured to sense a radius of curvature of the potential impact source of the actual impact source. In an embodiment, an optical sensor can sense a radius of curvature to determine if the impact source includes a sharp edge. In an embodiment, an acoustic sensor can sense a hardness of an impact source. In an embodiment, the one or more sensors can include a thermal sensor configured to sense one or more characteristics of the individual, the potential impact source, or the actual impact source. In an embodiment, the sensors 120 can include a force sensor configured to sense one or more characteristics of the actual impact. The force sensor can include a pressure sensor, a transducer, a displacement sensor, etc. In an embodiment, the sensors 120 can include one or more acoustic sensors configured to sense one or more characteristics of the individual, the potential impact source, or the actual impact source. For example, example, an acoustic sensor can sense a hardness of an impact source. In an embodiment, the sensors 120 can include an inertia sensor (e.g., MEMS inertia sensor) configured to sense movement of the individual. In an embodiment, the sensors 120 can include a heart rate monitor configured to sense the heart rate of the individual. In an embodiment, the sensors 120 can include a moisture sensor configured to sense sweat, blood, other body fluids, or other fluids.

The sensors 120 can be configured to sense one or more of direction of travel of at least a portion of the individual, velocity of at least a portion of the individual, acceleration of the individual, deceleration of at least a portion of the individual, a pressure applied to a portion of the individual or one or more sensors on the protective garment worn by the individual, a radius of curvature of the object contacting the protective garment system, a predicted force (e.g., tension, stress, strain, etc.) on a body part of the individual, or a direction of likely impact to at least one body part of the individual.

It should be also appreciated that, additionally or alternatively, one or more sensors can be positioned remotely from the individual 102. For example, sensors 120 can include one or more cameras, one or more thermal imaging devices, etc., that can sense an actual or impending impact. Such remote sensors can send one or more signals to the controller 200, and the controller 200 can control or direct operation of the activation mechanism(s) or movement of the shield segments 110 at least partially responsive to or based on the signals received from the sensor(s).

In some embodiments, sensors can be included or incorporated in a device or system that can be carried by the user, which can operably connect to the controller 200. For example, the sensors can be included in a personal electronic device (e.g., smart phone) that can be carried by the user. Furthermore, the input devices (e.g., sensor(s), personal electronic device(s), etc.) can couple or connect to the controller 200 in any number of suitable ways. For example, the input devices can have a wired or wireless connection with the controller 200.

In an embodiment, the shield segments 110 can be moved together to reconfigure the protective garment 100 from the undeployed configuration into the deployed configuration. Similarly, the shield segments 110 can be moved away from one another to reconfigure that protective garment 100 from the deployed configuration into the undeployed configuration. As described herein, one or more activation mechanism (s) can move the shield segments 110 relative to one another and can be controlled by the controller 200. Accordingly, the controller 200 can reconfigure or direct reconfiguration of the protective garment 100 between the unprotected and deployed configurations at least in part based on the input received at the controller 200 (e.g., based on signals received from one or more sensors, from the individual 102, from a third-party, combinations of the foregoing, etc.).

In an embodiment, the controller 200 can include memory or storage for storing data. For example, control electrical circuitry of the controller 200 can be configured to store data that includes the number of times one or more forces were applied to at least one of the shield segments 110. Additionally or alternatively, the controller 200 can store data related to the magnitude of the one or more forces applied to at least one of the shield segments 110. Furthermore, in an embodiment, the controller 200 can store data related to direction of the one or more forces applied to at least one of the shield segments 110. In an embodiment, the controller 200 can be configured to send at least some of the stored data to another device or system (e.g., to another control electrical circuitry, a handheld device, a personal computer, combinations thereof, etc.).

In some embodiments, the shield segments 110 can be moved responsive to the internal or external force(s) applied thereto. For example, the activation mechanism can apply internal force(s) onto one or more shield segments 110, thereby producing relative movement therebetween. As described below in more detail, the activation mechanism can include a suitable energy field (e.g. magnetic field, electric field, etc.), mechanically controlled mechanism(s), electromechanical mechanism(s), resilient elements (e.g., resilient elements that can have stored energy therein), hydraulic or pneumatic mechanisms, etc.

In at least one embodiment, the shield segments 110 can be moved responsive to the external force, such as external forces that can be produced by an impact. For example, sliding or relative movement of the shield segments 110 can redirect or deflect the force applied thereto by the impact. For example, sliding or moving of the shield segments 110 can reduce the force experienced by the individual 102 from the impact by transforming the direction of the force from a direct or substantially direct to an indirect (e.g., by transforming a director substantially direct impact to a glancing impact). Alternatively or additionally, the shield segments 110 can at least partially connect or lock together (as described herein), thereby distributing the applied force(s) among multiple shield segments.

Moreover, the shield segments 110 can retract back to original positions after the applied force is reduced or removed (e.g., after impact). For example, after the impact, the shield segments 110 can at least partially retract back to the previous or original positions, such as to the positions before the application of the force. In an embodiment, when an external force (e.g., force generated by or related to an impact) is applied onto the shield segments, the protective garment 100 can be reconfigured from the undeployed configuration to the deployed configuration. Furthermore, as the external force (e.g., force generated by or related to the impact) is reduced or removed from the shield segments 110 of the protective garment 100, the shield segments 110 can at least partially move back to the respective positions or location occupied thereby before the impact.

Generally, the shield segments 110 can be movable relative to the supportive member 105. For example, movement of the shield segments 110 can reconfigure the protective garment 100 from an undeployed configuration to a deployed configuration and vice versa. In an embodiment, moving two or more shield segments 110 toward one another or into contact with one another can reconfigure the protective garment 100 from the undeployed configuration into a deployed configuration. For example, in the deployed configuration, two or more shield segments 110 can connect together to form a substantially continuous or at least a partially continues outer surface of the protective garment 100. More specifically, for example, when two or more shield segments 110 are connected together at a location of an impact, the force produced by the impact can be distributed among the connected shield segments, thereby reducing the amount of force applied at the location of the impact (e.g., reducing the pressure produced by the protective garment 100 onto the protected body regions of the individual 102).

Generally, the shield segments 110 can have any number of suitable shapes. For example, the shield segments 110 can be circular, rectangular, triangular, polygonal, irregularly shaped, or combinations thereof. In an embodiment, the shapes of the shield segments 110 can be configured such as to form a pattern of connected shield segments 110, when the protective garment 100 is in the deployed configuration (e.g., such that the shield segments 110 are positioned adjacent to one another substantially without gaps therebetween).

Figure 2A:
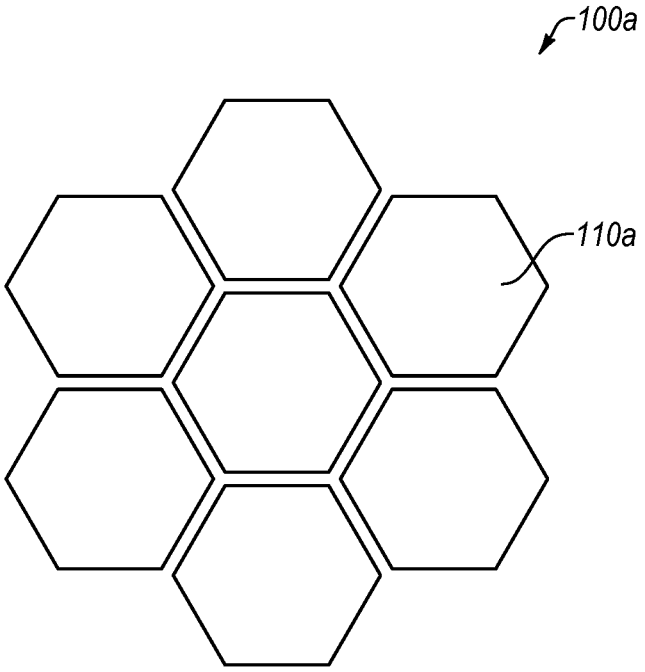
FIG. 2A is a schematic top view of a protective garment in an undeployed configuration, according to an embodiment.
Figure 2B:
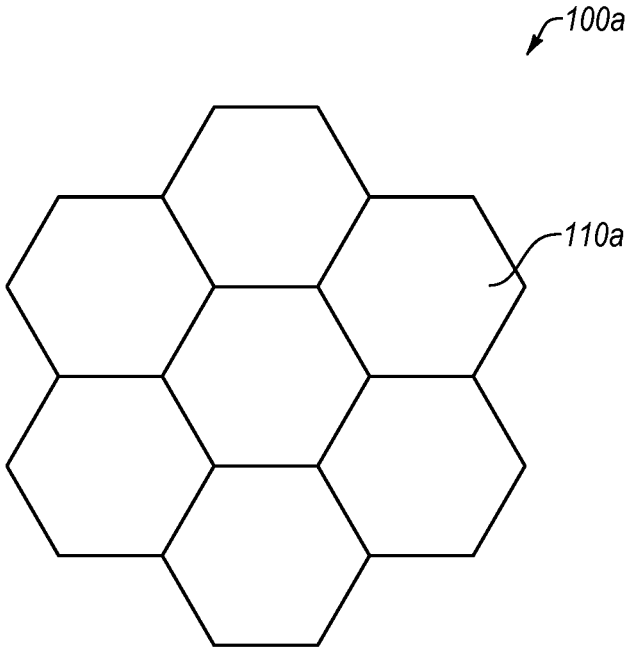
FIG. 2B is a schematic top view of a protective garment of FIG. 2A in a deployed configuration, according to an embodiment.

FIGS. 2A-2B illustrate a schematic top view of a protective garment 100*a* that includes polygonal shield segments 110*a*, according to an embodiment. More specifically, FIG. 2A illustrates the protective garment 100*a* in an undeployed configuration, and FIG. 2B illustrates the protective garment 100*a* in a deployed configuration, according to an embodiment.

In the illustrated embodiment, the shield segments 110*a* have generally hexagonal shapes. For example, as shown in FIG. 2A, when the protective garment 100*a* is in the undeployed configuration, the shield segments 110*a* can be spaced apart from one another. As described above, the shield segments 110*a* can be secured to a substrate or other supportive member. In an embodiment, the spacing between the shield segments 110*a* can allow the protective garment 100*a* to bend or deform responsive to movement of the individual wearing the protective garment 100*a* (e.g., deforming the substrate can move or tilt the shield segments 110*a* out of plane relative to each other).

As described below in more detail, in the deployed configuration, the protective garment 100*a* can have the shield segments 110*a* positioned adjacent to or near one another or in contact with one another. For example, when the protective garment 100*a* is in the deployed configuration, the shield segments 110*a* can be connected together, abut with, or overlap with each other in a manner that prevents or limits relative movement or tilting thereof. In an embodiment, in the deployed configuration, the shield segments 110*a* can form a substantially continuous outer surface or a substantially continuous shield layer that can protect the individual from an impact to the outer surface of the protective garment 100*a*. For example, when some or all of the shield segments 110*a* are in the deployed configuration, the external force(s) applied thereto (e.g., forces generated by an impact) can be distributed among some or all of the shield segments 110*a*, thereby reducing the pressure experienced by the individual wearing the protective garment 100*a*.

As mentioned above, the shield segments can have any number of suitable shapes, sizes, configurations, or combinations of the foregoing. In an embodiment, a lateral dimension of the shield segments 110*a* (e.g., a dimension between opposing sides or opposing apexes of the shield segments 110*a*) can be similar to or greater than the thickness of the shield segments 110*a* (e.g., substantially greater). For example, the lateral dimension of the shield segments 110*a* can be 1.1×, 1.5×, 2×, 3×, 4×, 5×, 10×, 100×, or more than 100 times greater than the thickness of the shield segments 110*a*. Generally, the shield segments 110*a* can have any suitable thickness. In an embodiment, the thickness of the shield segments 110*a* can be in one or more of the following ranges: from about 0.005 inches to about 0.020 inches; from about 0.015 inches to about 0.050 inches; from about 0.035 inches to about 0.100 inches; from about 0.85 inches to about 0.200 inches; from about 0.150 inches to about 0.300 inches. It should be appreciated, however, that the thickness of the shield segments 110*a* can be greater than 0.300 inches or less than 0.005 inches.

Figure 3A:
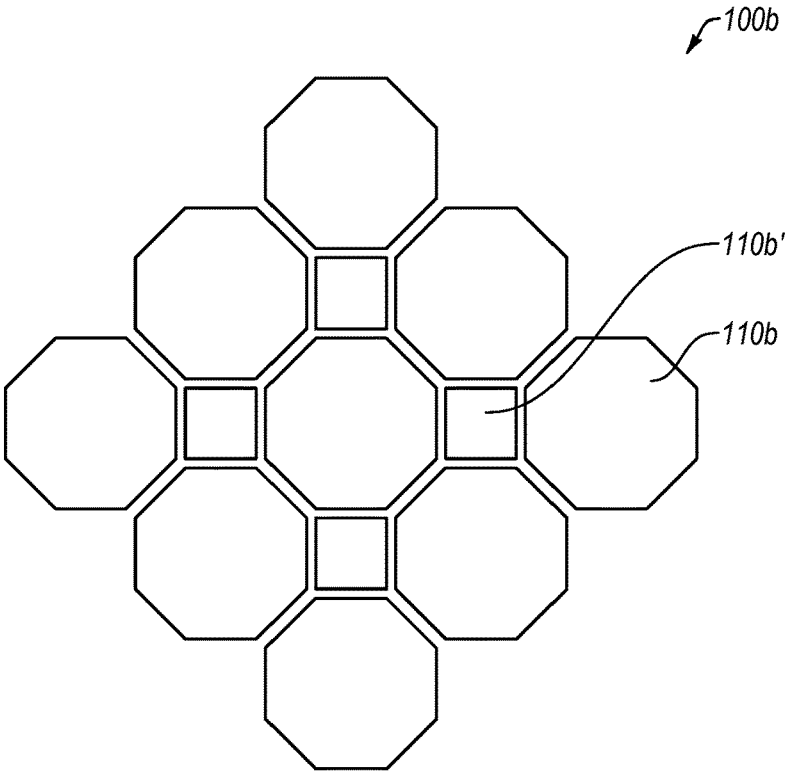
FIG. 3A is a schematic top view of a protective garment in an undeployed configuration, according to an embodiment.
Figure 3B:
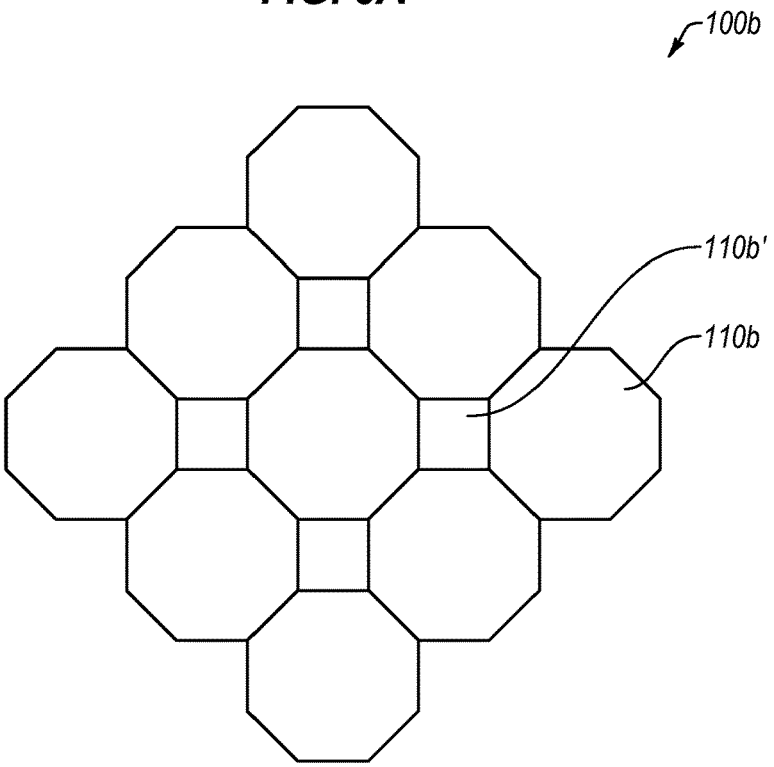
FIG. 3B is a schematic top view of a protective garment of FIG. 3A in a deployed configuration, according to an embodiment.

Moreover, a protective garment can include shield segments that have different shapes, sizes, configurations, or combinations thereof. FIGS. 3A-3B illustrate protective garment 100*b* according to an embodiment. More specifically, FIG. 3A illustrates the protective garment 100*b* in an undeployed configuration, and FIG. 3B illustrates the protective garment 100*b* in a deployed configuration, according to an embodiment. Except as otherwise described herein, the protective garment 100*b* and its elements and components can be similar to or the same as the protective garment 100*a* (FIGS. 2A-2B) and its corresponding elements and components.

In an embodiment, the protective garment 100*b* includes shield segments 110*b* and 110*b*' that can be movably or slidably secured to a substrate or other supportive member. For example, the shield segments 110*b* can have generally octagonal shapes and the shield segments 110*b*' can have generally rectangular or square shapes. As noted above, the sizes of the shield segments 110*b* and shield segments 110*b*' can vary from one embodiment to the next. For example, the lengths of the sides of the shield segments 110*b* and shield segments 110*b*' can be substantially the same, such that when the protective garment 100*b* is reconfigured into the deployed configuration, as shown in FIG. 3A, the shield segments 110*b* and the shield segments 110*b*' can collectively form or define a substantially continuous outer surface of the protective garment 100*b* (e.g., a shield segment 110*b*' can be positioned in the middle or surrounded by four shield segments 110*b*).

Figure 4A:
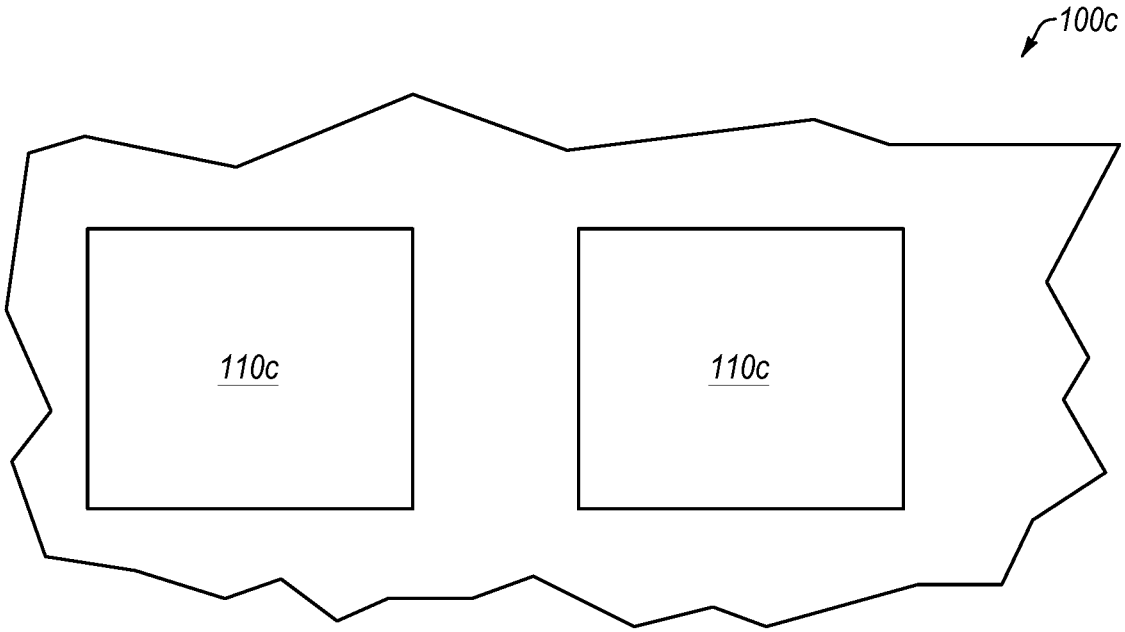
FIG. 4A is a schematic top view of a protective garment in an undeployed configuration, according to an embodiment.
Figure 4B:
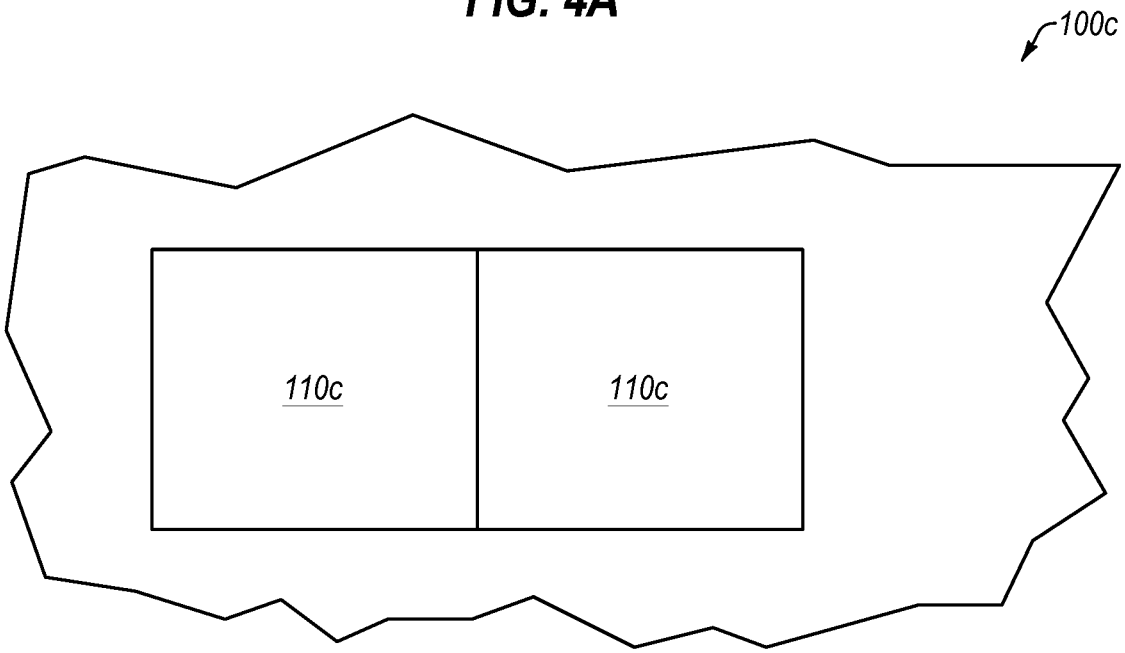
FIG. 4B is a schematic top view of a protective garment of FIG. 4A in a deployed configuration, according to an embodiment.

Again, the shapes and sizes of the shield segments can vary from one embodiment to the next. Hence, one, some, or each of the shield segments can be shaped in a manner that produces or forms gaps between the shield segments, when the protective garment is in the undeployed configuration or when at least some of the shield segments are positioned near or adjacent to one another. For example, FIGS. 4A-4B schematically illustrate a partial top view of a protective garment 100*c* that includes shield segments 110*c* according to an embodiment. In particular, FIG. 4A illustrates the shield segments 110*c* disengaged from each other, and FIG. 4B illustrates the shield segments 110*c* engaged with each other, according to an embodiment. Except as described herein, the shield segments 110*c* and their elements and components can be similar to or the same as any of the shield segments described herein.

As mentioned above, the shield segments 110*c* can move between a first position and a second position. For example, the shield segments 110*c* can move toward each other and can contact each other responsive to an external force(s) applied thereto (e.g., force(s) generated by an impact). Alternatively or additionally, in an embodiment, an activation mechanism can move the shield segments 110*c* close or into contact with each other. For example, an internal force, such as an internal force generated by an energy field(s), resilient element(s), etc., can move the shield segments 110*c* toward each other or away from each other (e.g., between engaged and disengaged positions). For example, when the shield segments 110*c* are engaged with one another, the protective garment 100*c* can be in the deployed configuration. Conversely, once the shield segments 110*c* are disengage from each other, the protective garment 100*c* can be in the undeployed configuration.

In an embodiment, the activation mechanism can restrain or secure together the shield segments 110*c* engaged with each other or coupled to one another. Alternatively or additionally, the shield segments can include one or more interface or interlock features that can at least partially restrain relative movement thereof when the shield segments are positioned near or adjacent to each other. For example, the interlock features or portions of the shield segments can have complementary shapes (e.g., that can at least partially restrain or limit relative movement of the shield segments, such as when the shield segments are engaged with each other).

Figure 5A:
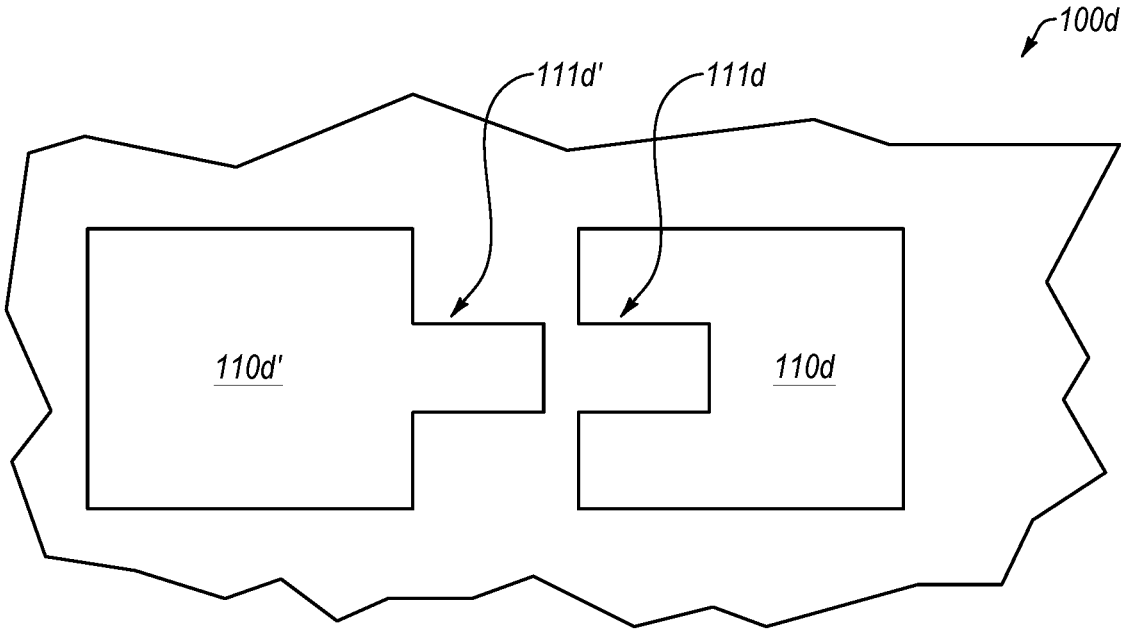
FIG. 5A is a schematic top view of a protective garment in an undeployed configuration according to an embodiment.
Figure 5B:
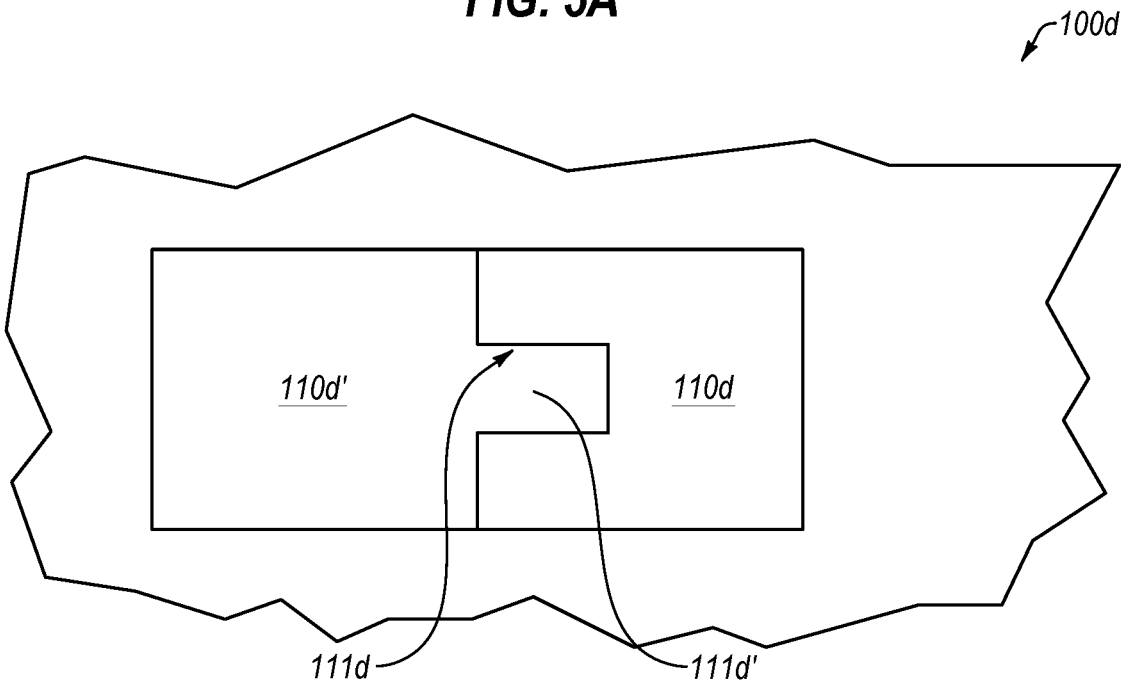
FIG. 5B is a schematic top view of a protective garment of FIG. 5A in a deployed configuration, according to an embodiment.

FIGS. 5A-5B schematically illustrate a partial top view of a protective garment 100*d* that includes shield segments 110*d*, 110*d*' according to an embodiment. In particular, FIG. 5A illustrates the shield segments 110*d* and 110*d*' disengaged from each other, and FIG. 5B illustrates the shield segments

110*d* and 110*d*' engaged with each other, according to an embodiment. Except as described herein, the shield segments 110*d* and 110*d*' and their elements and components can be similar to or the same as any of the shield segments described herein.

In an embodiment, the shield segments 110*d* and 110*d*' can have locating or locking elements 111*d* and 111*d*', respectively. For example, the locking elements 111*d* and 111*d*' can facilitate positioning of the shield segments 110*d* and 110*d*' relative to each other as the shield segments 110*d* and 110*d*' approach or come into contact with each other. Furthermore, the locking elements 111*d*, 111*d*' can lock together the shield segments 110*d* and 110*d*' (e.g., the locking elements 111*d*, 111*d*' can restrain or inhibit the shield segments 110*d* and 110*d*' from sliding or moving away from each other).

As shown in FIGS. 5A-5B, the locking elements 111*d* and 111*d*' can have complementary shapes, such as at least one portion of one of the locking elements 111*d*, 111*d*' fits into at least one portion of the other of the locking elements 111*d*, 111*d*'. For example, the locking element 111*d*' can fit into the locking element 111*d*. In an embodiment, the locking elements 111*d* and 111*d*' can have any number of suitable features or elements that can restrain relative movement of the shield segments 110*d* and 110*d*'. For example, the locking elements 111*d* and 111*d*' can have a press- or friction-fit therebetween, which can secure together the shield segments 110*d* and 110*d*'. Alternatively or additionally, the locking elements 111*d* and 111*d*' can include one or more interference elements or features, such as barbs, knobs, etc., which can inhibit relative movement of the shield segments 110*d* and 110*d*' away from each other. In some embodiments, the locking elements 111*d* and 111*d*' can have complementary locking tapers that can facilitate mating of the locking elements 111*d* and 111*d*' or can lock the locking elements 111*d* and 111*d*' together, thereby securing together shield segments 110*d* and 110*d*'.

Generally, as mentioned above, the shield segments of the protective garment can be secured or positioned near the individual wearing the protective garment. In an embodiment, the shield segments can be secured to a substrate or other supportive member that can be secured to or worn by the individual. For example, the substrate can include, or can be secured to or integrated with one or more garments or clothing that can be worn by the individual. In an embodiment the supportive member includes an article of clothing or apparel. In an embodiment the supportive member includes protective gear (e.g., a rib guard or hockey girdle). In an embodiment the supportive member includes a supportive gear or apparel such as a wrap, a brace, or an athletic supporter. In an embodiment the supportive member includes a bandage or wound dressing.

Figure 6A:
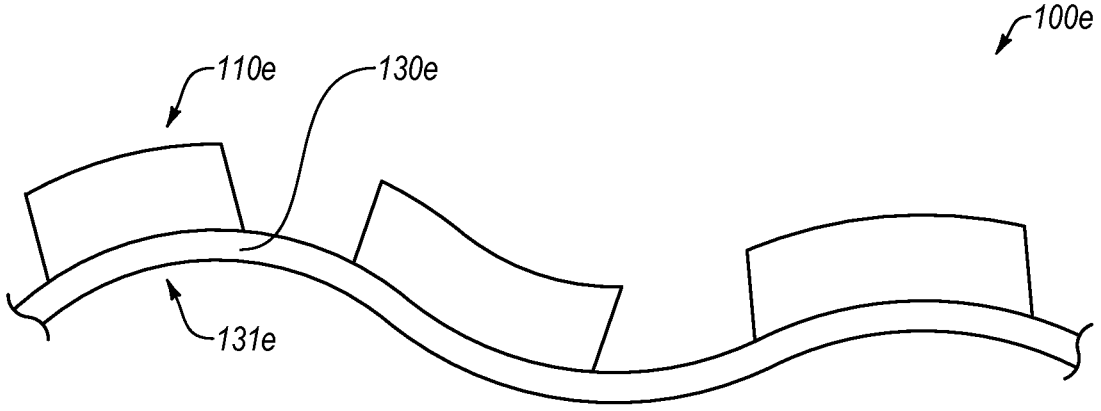
FIG. 6A is a schematic side view of a protective garment in an undeployed configuration, according to an embodiment.
Figure 6B:
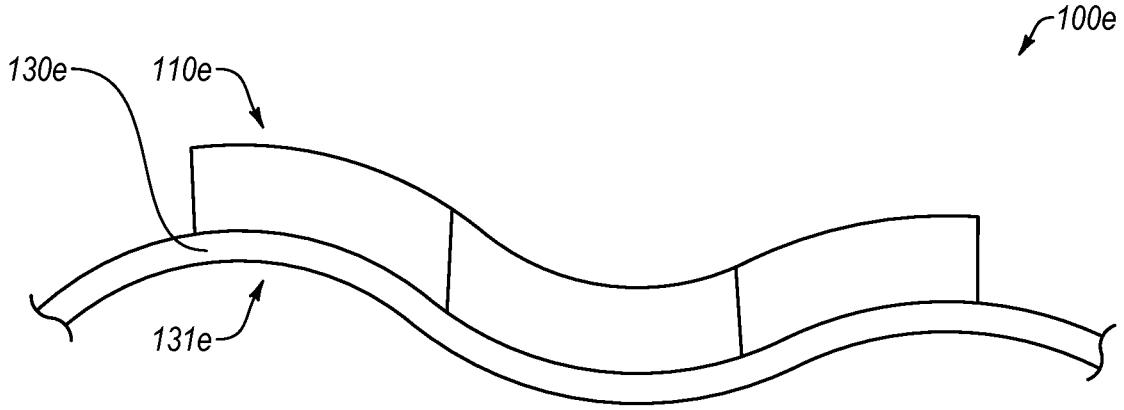
FIG. 6B is a schematic side view of a protective garment of FIG. 6A in a deployed configuration, according to an embodiment.

FIGS. 6A-6B schematically illustrate portions of a protective garment 100*e* that includes shield segments 110*e* secured to a substrate 130*e*, according to an embodiment. Specifically, FIG. 6A shows the protective garment 100*e* in an undeployed configuration, and FIG. 6B shows the protective garment 100*e* in a deployed configuration. For example, as described above, the shield segments 110*e* can move or slide toward or into contact with one another to reconfigure the protective garment 100*e* from the undeployed configuration into the deployed configuration. Conversely, the shield segments 110*e* can move away from one another to reconfigure the protective garment 100*e* from the deployed configuration to the undeployed configuration.

In an embodiment, the substrate 130*e* can be conformed or conformable to one or more body regions of an individual. For example, the substrate 130*e* can have an inner surface 131*e* that can be conformed or conformable to one or more body regions of the individual. The inner surface 131*e* can be positioned over clothing worn by the individual, or the substrate 130*e* can form or define at least part of the clothing worn by the individual (e.g., the inner surface 131*e* can be positioned over or adjacent to the skin of the individual). In an embodiment, the substrate 130*e* can be substantially flexible (e.g., the substrate 130*e* can be cloth or sheet material, such as cotton sheet material, synthetic sheet material, rubber, neoprene, sheet-shaped foam, etc.). Alternatively, the substrate 130*e* can include rigid or resilient material (e.g., plastic, hard foam, metal, etc.).

Generally, the shield segments 110*e* can be secured to the substrate 130*e* in any suitable manner or with any number of suitable connectors. As described below in more detail, the shield segments 110*e* can be secured near or adjacent to the individual (e.g., adjacent to the inner surface 131*e* of the substrate 130*e*) by at least one resilient member. For example, resilient member(s) can be configured to elastically extend to allow or enable at least one of the plurality of shield segments to move from a first position to a second position responsive to one or more forces applied thereto. Alternatively or additionally, resilient member(s) can be configured to contract to return the at least one of the plurality of shield segments from the second position to the first position.

In an embodiment, the substrate 130*e* can include or define a generally elastic material (e.g., rubber, neoprene, etc.) that can form or define at least one resilient member. For example, the shield segments 110*e* can be attached or secured directly to the substrate 130*e*. Alternatively or additionally, the shield segments 110*e* can be integrated with the substrate 130*e* (e.g., the shield segments 110*e* can be bonded to the substrate 130*e*, woven to or into the substrate 130*e*, etc.).

In an embodiment, as the shield segments 110*e* move or slide toward one another, the substrate 130*e* can stretch or deform to accommodate or allow such movement or sliding. It should be appreciated that the shape or bends of the substrate 130*e* can change (e.g., the shape of the inner surface 131*e*). For example, shield segments 110*e* can move or slide along the various curves (e.g., peaks and valleys) as the shield segments 110*e* move or slide toward or into contact with one another or away from one another. Alternatively, the interface along which shield segments 110*e* move or slide can be substantially planar.

Figure 7:
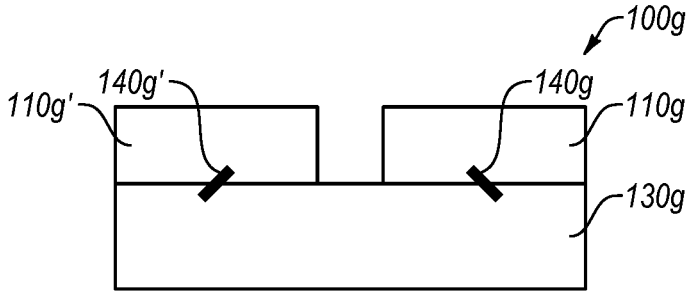
FIG. 7 is a schematic side view of a protective garment, according to an embodiment.

As described above, the shield segments of the protected garment can move or slide (toward or away from each other) responsive to one or more forces applied thereto (e.g., internal or external forces, such as force(s) generated by an impact). Generally, internal force(s) can be generated with or by any number of suitable activation mechanisms, which can vary from one embodiment to another. FIG. 7 illustrates a schematic side view of a protective garment 100*g*, according to an embodiment. Except as described herein, the protective garment 100*g* and its elements and components can be similar to or the same as any of the protective garments described herein. For example, the protective garment 100*g* can include shield segments 110*g*, 110*g*' that can be similar to or the same as any of the shield segments described herein.

In an embodiment, the shield segments 110*g*, 110*g*' can be secured to a substrate 130*g*. For example, at least one resilient member can secure the shield segments 110*g*, 110*g*' to the substrate 130*g*. In the illustrated embodiment, the protective garment 100*g* can include resilient members

140*g*, 140*g*' that can be connected to or integrated with the substrate 130*g* and to the respective shield segments 110*g*, 110*g*'. For example, the resilient members 140*g*, 140*g*' can include a mechanical spring (e.g., a compression spring) or a resilient material such as a strip or tab formed from neoprene, or rubber. As the shield segments 110*g*, 110*g*' move toward each other (e.g., responsive to force(s) applied thereto, such as forces generated by an impact), the resilient members 140*g*, 140*g*' can apply forces directed in generally opposite directions to the forces that move the shield segments 110*g*, 110*g*' toward each other.

As the shield segments 110*g*, 110*g*' move or slide toward each other, the resilient members 140*g*, 140*g*' can extend to accommodate such movement. Specifically, for example, as the shield segments 110*g*, 110*g*' move from a first position to a second position (e.g., where the shield segments 110*g*, 110*g*' are closer to each other in the second position), the resilient members 140*g*, 140*g*' can elastically deform or extend in length from a first length to a second length (e.g., where the second length is greater than the first length). Furthermore, in the extended configuration, the resilient members 140*g*, 140*g*' can apply force to the shield segments 110*g*, 110*g*' directed generally opposite to the force moving or sliding the shield segments 110*g*, 110*g*' closer to each other (e.g., generally opposite to external force(s)). Hence, for example, as the force that moves or slides the shield segments 110*g*, 110*g*' closer together is reduced or removed (e.g., after impact), the shield segments 110*g*, 110*g*' can move farther apart from one another.

Alternatively or additionally, the shield segments 110*g*, 110*g*' can move or slide from a first position (spaced apart from each other) to a second position (spaced farther apart from each other). For example, as the shield segments 110*g*, 110*g*' move or slide from the first position to the second position, the resilient members 140*g*, 140*g*' can elastically deform or extend in length from a first length to a second length (e.g., where the second length is greater than the first length). Furthermore, in the extended configuration, the resilient members 140*g*, 140*g*' can apply force to the shield segments 110*g*, 110*g*' directed generally opposite to the force moving or sliding the shield segments 110*g*, 110*g*' farther from each other (e.g., opposite to one or more external forces). Hence, for example, as the force that moves the shield segments 110*g*, 110*g*' farther from each other is reduced or removed (e.g., after impact), the shield segments 110*g*, 110*g*' can move closer together, such as to their respective original positions (e.g., where the protective garment 100*g* is in the undeployed configuration).

In an embodiment, when the protective garment 100*g* is in the undeployed configuration, the shield segments 110*g*, 110*g*' can be positioned spaced from one another. For example, an impact can apply external force(s) to the shield segments 110*g*, 110*g*' and can move or slide the shield segments 110*g*, 110*g*' closer together or farther apart. Moreover, as described above, the protective garment 100*g* can include any number of shield segments (e.g., which can be similar to or the same as the shield segments 110*g*, 110*g*'). Hence, for example, an impact can generate or apply force on the shield segments of the protective garment 100*g* such that two or more of the shield segments move closer to each other and two or more shield segments move farther away from each other (e.g., a shield segment and a second shield segment can move close to each other, and the second shield segment and a third shield segment can move farther away from each other).

In an embodiment, as the shield segments 110*g*, 110*g*' move closer to each other or farther apart from each other, the force applied thereto (e.g., external force) can be at least partially deflected. For example, the direction of the force can be changed (e.g., the object impacting the shield segments 110*g*, 110*g*' can slide or move at least partially together with the shield segments 110*g*, 110*g*' in a manner that at least partially changes direction of the forces generated by the impact). Under one or more operating conditions, as the shield segments 110*g*, 110*g*' slide or move, the impact can be changed from a direct impact or blow to a glancing impact or glancing blow. Moreover, at least a portion of the impact energy can be absorbed by movement of the shield segments 110*g*, 110*g*' (e.g., at least some of the energy of the impact can be transferred to expanding the resilient members 140*g*, 140*g*' or to overcoming frictional forces between the shield segments 110*g*, 110*g*' and the substrate 130*g*).

As described above, the protective garment 100*g* can include a single resilient member. For example, the substrate 130*g* can include resilient material and can secure the shield segments 110*g*, 110*g*', such that movement or sliding of the shield segments 110*g*, 110*g*' relative to one another can elastically deform the substrate 130*g* (e.g., extending the length of at least a portion of the substrate 130*g* from a first length to a second length that is greater than the first length). In an embodiment, the entire or a portion of the substrate 130*g* can be resilient (e.g., such as to elastically deform or stretch from a first to a second suitable length). Moreover, the entire substrate 130*g* or a portion of the substrate 130*g* can be substantially un-expandable from a first to a second suitable length (e.g., without plastic deformation or failure). Furthermore, in an embodiment, one or more of the shield segments 110*g* of the protective garment 100*g* can be connected directly to the substrate 130*g* (e.g., the shield segments 110*g* can be connected to a resilient substrate 130*g* or to a resilient portion of the substrate 130*g*) or one or more shield segments of the protective garment 100*g* can be connected to the substrate 130*g* with one or more resilient members.

Figure 8:
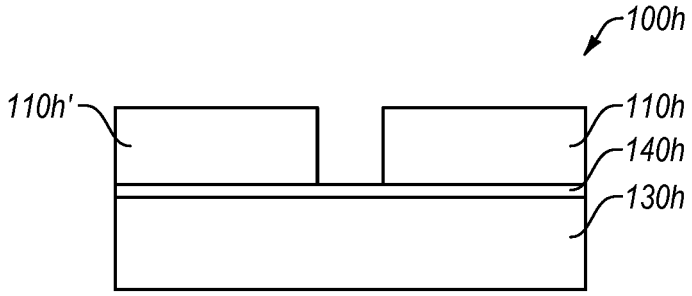
FIG. 8 is a schematic side view of a protective garment, according to an embodiment.

As described above, in an embodiment, the protective garment can include a single resilient member. FIG. 8 illustrates a schematic side view of a protective garment 100*h*, according to an embodiment. Except as described herein, the protective garment 100*h* and its elements and components can be similar to or the same as any of the protective garments described herein. For example, the protective garment 100*h* can include shield segments 110*h*, 110*h*' that can be similar to or the same as any of the shield segments described herein.

In an embodiment, the protective garment 100*h* includes a single resilient member 140*h* that can secure the shield segments 110*h*, 110*h*' to a substrate 130*h*. For example, the resilient member 140*h* can include resilient material that can elastically deform as the shield segments 110*h*, 110*h*' move or slide closer together or farther away from each other. For example, the resilient member 140*h* can exhibit an in-plane deformation, such that an upper surface thereof (which can be connected to the shield segments 110*h*, 110*h*') is displaced relative to the bottom surface (which can be connected to the substrate 130*h*), thereby allowing the shield segments 110*h*, 110*h*' to move closer to each other or farther away from each other.

Additionally or alternatively, at least some portions of the resilient member 140*h* can be decoupled from the substrate 130*h* at one or more locations or portions thereof. For example, the decoupled portions of the resilient member 140*h* can extend from a first length to a second (and vice versa) as the shield segments 110*h*, 110*h*' move or slide relative to each other. Conversely, the decoupled portions of the resilient member 140*h* can retract from the extended second length to or near the original first length to move or slide the shield segments 110*h*, 110*h*' away from each other.

Figure 9:
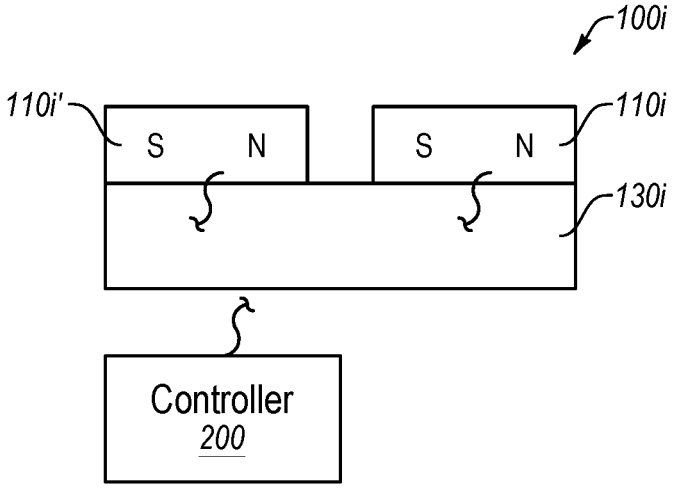
FIGS. 9-16 are a schematic side views of a protective garment, according to different embodiments.

As described above, in an embodiment, an external force (e.g., generated by an impact) can move the shield segments closer together or farther apart from one another. Alternatively, an internal force (e.g., a force generated by an activation mechanism) can move the shield segments closer together or farther apart from one another. FIG. 9 illustrates a schematic side view of a protective garment 100*i*, according to an embodiment. Except as described herein, the protective garment 100*i* and its elements and components can be similar to or the same as any of the protective garments described herein. For example, the protective garment 100*i* can include shield segments 110*i*, 110*i*' that can be similar to or the same as any of the shield segments described herein. For example, the shield segments 110*i*, 110*i*' can be operably secured to a substrate 130*i* (e.g., as described above).

In an embodiment, the shield segments 110*i*, 110*i*' can move or slide closer one to another or into contact with one another responsive to an internal force. The shield segments 110*i*, 110*i*' can move farther from each other responsive to the internal force. For example, responsive to an internal force, the shield segments 110*i*, 110*i*' can move or slide into contact with each other to reconfigure the protective garment 100*i* from an undeployed configuration to a deployed configuration (e.g., forming a substantially continuous shield layer, as described above).

In an embodiment, the internal forces or interference forces can be generated or produced by an energy field (e.g., magnetic field, electric field, etc.). For example, as schematically shown in FIG. 9, the shield segments 110*i* and 110*i*' can include respective magnetic fields that can be oriented in a manner that attracts the shield segments 110*i* and 110*i*' to each other (e.g., the south pole of the magnetic field of the shield segment 110*i* can be positioned adjacent to the north pole of the magnetic field of the shield segment 110*i*'). Conversely, in an embodiment, the energy fields can be oriented in a manner that repels the shield segments 110*i* and 110*i*' from each other.

In an embodiment, the orientation of at least some of the energy field(s) can be controlled (directly or indirectly) by controller 200. The controller 200 can include a suitable control electrical circuitry to control or direct operation of the protective garment 100*i* (e.g., to control movement or sliding of the shield segments 110*i* and 110*i*'). For example, the controller 200 can determine or direct orientation of the energy field(s) that can force the shield segments 110*i*, 110*i*' to move closer together or farther apart from each other.

As described above, one or more sensors can be operably coupled to the controller 200. In an embodiment, the controller 200 can apply or change orientation of the energy field(s) based at least in part on one or more signals received from the one or more sensors operable coupled to the controller 200. In an embodiment, the controller 200 can be configured to send the one or more control signals to one or more elements or components configured to generate or produce the energy field(s) (e.g., to one or more electromagnets that can be connected to or integrated with the shield segments 110*i* or shield segments 110*i*).

For example, when the controller 200 determines that the signal(s) received from the sensor(s) correspond to sense at least one of a potential application of the one or more forces or an actual application of the one or more forces (e.g., external forces) to the protective garment 100*i*, the controller 200 can apply or orient the energy field(s) in a manner that moves the shield segments 110*i* and 110*i*' closer together or into contact with each other. Conversely, for example, when the controller 200 determines that the external force(s) are no longer applied to the protective garment 100*i*, the controller 200 can direct application or orientation of the energy field(s) in a manner that repels the shield segments 110*i* and 110*i*' from each other and forces the shield segments 110*i* and 110*i*' to move or slide away from one another.

In an embodiment, magnetized portions of the shield segments 110*i* or 110*i*' can be produced by corresponding electromagnets responsive to one or more control signals received thereby (e.g., control signals from the controller 200). Alternatively or additionally, one or more magnetized portions of the shield segments 110*i* or 110*i*' can include one or more permanent magnets. The control electrical circuitry of the controller 200 can be configured to send a control signal to the one or more electromagnets responsive to one or more signals received from the one or more sensors.

In an embodiment, the magnetic field(s) of the shield segments 110*i* can be produced or generated by a permanent magnet, and the magnetic field(s) of the shield segments 110*i*' can be produced or generated by an electromagnet. For example, in an embodiment, one or more shield segments can include permanent magnets and one or more shield segments can include electromagnets. In any event, in an embodiment, the controller 200 can generate or send one or more signals that can produce or direct generation of one or more energy fields (e.g., magnetic fields, electric fields, etc.) that can apply an internal force onto the shield segments 110*i* or 110*i*' in a manner that moves or slides the shield segments 110*i*, 110*i*' closer to each other or into contact with each other.

In an embodiment, the energy field(s) can secure together the shield segments 110*i* and 110*i*'. For example, as described above, the shield segments 110*i*, 110*i*' can be secured together (e.g., to form a substantially continuous shield layer). The controller 200 can control or direct selectively securing together of the shield segments 110*i*, 110*i*' (e.g., by applying suitable field(s)). Moreover, the controller 200 can detach the shield segments 110*i*, 110*i*' form each other or can force the shield segments 110*i*, 110*i*' away from each other (e.g., by reversing polarity of at least one energy field).

Figure 10:
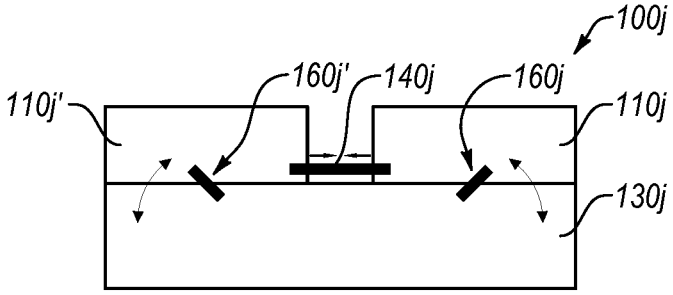

It should be appreciated that the protective garment or protective garment system can include any number of suitable mechanisms, elements, and components that can produce or generate any number of suitable internal forces (e.g., of suitable strengths, directions, etc.) that can move or slide the shield segments toward or into contact with one another and away from one another. FIG. 10 illustrates a schematic side view of a protective garment 100*j*, according to an embodiment. Except as described herein, the protective garment 100*j* and its elements and components can be similar to or the same as any of the protective garments described herein. For example, the protective garment 100*j* can include shield segments 110*j*, 110*j*' that can be similar to or the same as any of the shield segments described herein and can be operably secured to a substrate 130*j* (e.g., as described above).

In the illustrated embodiment, the protective garment 100*j* can include at least one resilient member 140*j* extending between or connecting together the shield segments 110*j*, 110*j*'. For example, the resilient member 140*j* can be in a stretched or extended configuration, such as to urge the shield segments 110*j*, 110*j*' toward each other. In an embodiment, the protective garment 100*j* can include locking elements 160*j*, 160*j*' that can selectively secure the respective shield segments 110*j* and shield segments 110*j*' at first positions or locations relative to each other (e.g., such that resilient member 140*j* is in the extended configuration or at a first length). Generally, the protective garment 100*j* can include any number and any type of suitable locking elements. For example, the locking elements 160*j*, 160*j*' can be latches configured to pivot between open and locking positions, such as a fastener, a clip, a snap-lock, a compression latch, a draw latch, a hook latch, an electromagnetic latch, or a magnetic latch.

For example, in the locking position, the locking elements 160*j* or 160*j*' can secure corresponding shield segments 110*j*, 110*j*' in the first position; in the open position, the locking elements 160*j*, 160*j*' can allow the shield segments 110*j*, 110*j*' to move or slide from the first position to the second position. In an embodiment, the shield segments 110*j*, 110*j*' can be farther apart in the first position than in the second position. For example, in the second position, the shield segments 110*j* shield segments 110*j*' can be in contact with each other or can be secured together.

In an embodiment, a controller can control or direct movement or pivoting of the locking elements 160*j*, 160*j*'. For example, the locking elements 160*j*, 160*j*' can be pivotable between the open and locking positions responsive to a signal received thereby (e.g., from the controller). When the locking elements 160*j*, 160*j*' move or pivot to the open positions, the shield segments 110*j*, 110*j*' can move closer together or into contact with each other (e.g., to reconfigure the protective garment 100*j* from an undeployed configuration to a deployed configuration, such as by forming a substantially continuous shield layer). For example, as described above, the controller can receive one or more signals from one or more sensors, and responsive to the one or more signals received from the sensor(s), the controller can move or pivot the locking elements 160*j*, 160*j*' from the locking to the open position.

Figure 11:
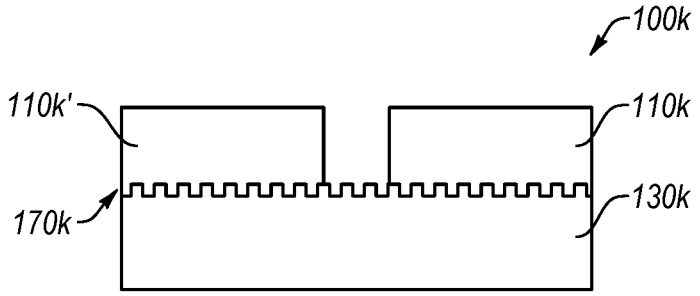

As described above, in an embodiment, the shield segments can move in a manner that deflects or redirects impact or dissipates or absorbs at least some of the energy of the impact, thereby reducing the energy transferred to the individual wearing the protective garment. FIG. 11 illustrates a schematic side view of a protective garment 100*k*, according to an embodiment. Except as described herein, the protective garment 100*k* and its elements and components can be similar to or the same as any of the protective garments described herein. For example, the protective garment 100*k* can include shield segments 110*k*, 110*k*' that can be similar to or the same as any of the shield segments described herein and can be operably secured or coupled to a substrate 130*k* (e.g., as described above).

In an embodiment, the protective garment 100*k* can include one or more interference elements 170*k* (e.g., protrusions, posts, ribs, etc.), positioned between the shield segments 110*k*, 110*k*' and the substrate 130*k*. For example, the at least some of the interference elements 170*k* can extend outward from the substrate 130*k* and toward the shield segments 110*k*, 110*k*'. Additionally or alternatively, at least some of the interference elements 170*k* can extend outward from the shield segments 110*k*, 110*k*' toward the substrate 130*k*. For example, the shield segments 110*k*, 110*k*' or the substrate 130*k* can include one or more recesses that can accept the interference elements 170*k* therein. Moreover, as the shield segments 110*k*, 110*k*' move or slide toward each other, the interference elements 170*k* can exit and reenter the recesses.

In an embodiment, the interference elements 170*k* can include flexible or resilient material. For example, the interference elements 170*k* can bend, stretch, deform, etc., as the shield segments 110*k*, 110*k*' move or slide toward or away from each other. As the external force(s) generated by the impact move to the shield segments 110*k*, 110*k*', at least some energy of the impact can be dissipated to produce the movement of shield segments 110*k*, 110*k*'. Hence, as the interference elements 170*k* impede the movement, more energy of the impact is dissipated (e.g., as compared to energy dissipated when moving the shield segments 110*k*, 110*k*' without the interference elements).

Generally, the interference elements 170*k* can have any number of suitable shapes, sizes, arrangements, etc., which can vary from one embodiment to the next. For example, the interference elements 170*k* can be posts, ribs, ridges, etc. Moreover, in an embodiment, the interference elements can be retractable. For example, an energy field can move the interference elements 170*k* outward or inward relative to the interface between the substrate 130*k* and the shield segments 110*k*, 110*k*'. In an embodiment, one, some, or each of the interference elements 170*k* and activation or actuation mechanism(s) thereof can be located on or at least partially in the substrate 130*k*.

In an embodiment, the controller can control or direct movement or retracting of the interference elements 170*k* (e.g., responsive to one or more signals received from one or more sensors, as described above). For example, the one or more sensors positioned and configured to sense an impending application of one or more forces against the protective garment can send corresponding signals to the controller; responsive to such signals, the controller can move or direct movement of the interference elements 170*k* outward, such as to engage corresponding recesses in the substrate 130*k* or shield segments 110*k*, 110*k*'. Conversely, for example, in the absence of such signals, the controller can move or direct movement of the interference elements 170*k*, such as to retract the interference elements 170*k* (e.g., such that the shield segments 110*k*, 110*k*' can slide toward or away from each other with reduced sliding resistance as compared to the sliding resistance when the interference elements 170*k* are moved to extend outward at the interface between the shield segments 110*k*, 110*k*' and the substrate 130*k*). For example, the movement or retracting of the interference elements can be effected by one or more actuators, such piezoelectric or shape memory alloy actuators.

Figure 12:
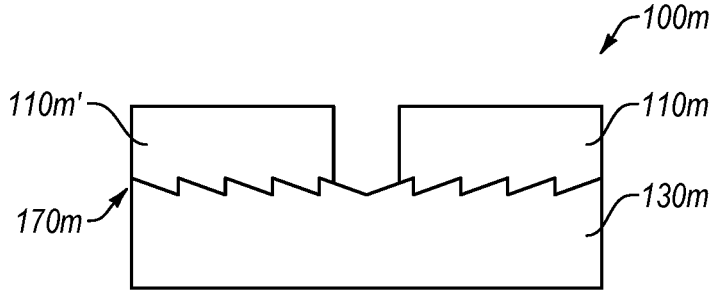

As mentioned above, the interference elements can have any number of suitable shapes and sizes. FIG. 12 illustrates a schematic side view of a protective garment 100*m*, according to an embodiment. Except as described herein, the protective garment 100*m* and its elements and components can be similar to or the same as any of the protective garments described herein. For example, the protective garment 100*m* can include shield segments 110*m*, 110*m*' that can be similar to or the same as any of the shield segments described herein and can be operably secured or coupled to a substrate 130*m* (e.g., as described above).

In an embodiment, the protective garment 100*m* can include one or more interference elements 170*m* that can be shaped or configured as barbs. For example, the interference elements 170*m* can be configured and oriented such that as the shield segments 110*m*, 110*m*' move or slide toward each other, the interference elements 170*m* can resist or impede sliding of the shield segments 110*m*, 110*m*', thereby absorbing energy of an impact that can force the shield segments 110*m*, 110*m*' toward each other. Additionally or alternatively, the interference elements 170*m* can be configured such that the shield segments 110*m*, 110*m*' can move or slide away from each other substantially unimpeded or with less sliding resistance than toward each other. It should be appreciated that the interference elements 170*m* (as well as any of the interference elements described herein) can be attached to or incorporated with the shield segments 110*m*, 110*m*'.

For example, as described above, after an impact, one or more mechanisms can move the shield segments 110*m*, 110*m*' away from each other (e.g., such as to reconfigure the protective garment 100*m* from a deployed configuration into an undeployed configuration). In an embodiment, the one or more mechanisms can move or slide the shield segments 110*m*, 110*m*' away from each other (e.g., to original positions or locations) with less resistance than movement or sliding of the shield segments 110*m*, 110*m*' (e.g., moving the shield segments 110*m*, 110*m*' away from each other can be performed with less force than moving or sliding the shield segments 110*m*, 110*m*' toward each other. For example, a resilient member can move or slide the shield segments 110*m*, 110*m*' away from each other, and the resilient member can apply less force onto the shield segments 110*m*, 110*m*' than the external force from an impact.

Figure 13:
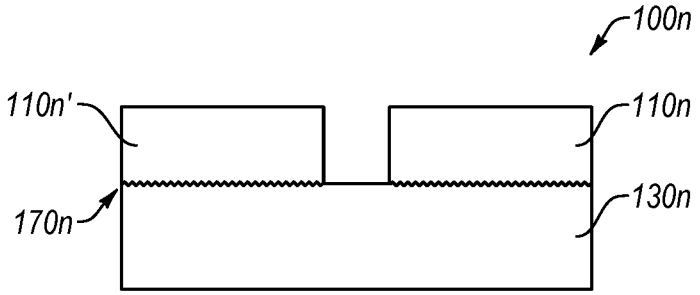

In an embodiment, the sliding resistance of the shield segments can be the same when the shield segments that move or slide toward each other as when the shield segments move or slide away from each other. FIG. 13 illustrates a schematic side view of a protective garment 100*n*, according to an embodiment. Except as described herein, the protective garment 100*n* and its elements and components can be similar to or the same as any of the protective garments described herein. For example, the protective garment 100*n* can include shield segments 110*n*, 110*n*' that can be similar to or the same as any of the shield segments described herein and can be operably secured or coupled to a substrate 130*n* (e.g., as described above).

In an embodiment, the protective garment 100*n* can include one or more interference elements 170*n* that can impede movement or sliding of the shield segments 110*n*, 110*n*'. For example, the interference elements 170*n* can be one or more elements or materials that can increase sliding resistance between the shield segments 110*n*, 110*n*'. In an embodiment, the interference elements 170*n* can increase the amount of force required to move or slide the shield segments 110*n*, 110*n*' toward or away from each other. For example, the interference elements 170*n* can include a suitable surface roughness or texture on the surfaces of the shield segments 110*n*, 110*n*' or substrate 130*n*. In an embodiment, the interference elements 170*n* can increase friction between the substrate 130*n* and the shield segments 110*n*, 110*n*' when the shield segments 110*n*, 110*n*' move or slide in any direction relative to the substrate 130*n*.

Figure 14:
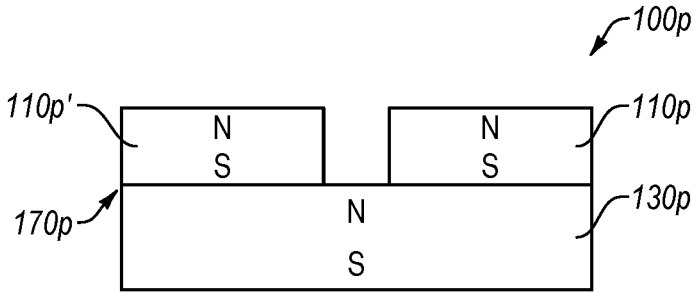

Furthermore, in an embodiment, the sliding resistance between the shield segments and the substrate can be selectively increased or decreased. FIG. 14 illustrates a schematic side view of a protective garment 100*n*, according to an embodiment. Except as described herein, the protective garment 100*p* and its elements and components can be similar to or the same as any of the protective garments described herein. For example, the protective garment 100*p* can include shield segments 110*p*, 110*p*' that can be similar to or the same as any of the shield segments described herein and can be operably secured or coupled to a substrate 130*p* (e.g., as described above).

For example, the protective garment 100*p* can include interference elements 170*p* that can include one or more energy fields that can attract or repel the substrate 130*p* relative to the shield segments 110*p*, 110*p*'. In an embodiment, the interference elements 170*p* can include electromagnetic elements that generate one or more magnetic fields. For example, the interference elements 170*p* can include electromagnetic elements that can generate magnetic fields that are oriented in such as to attract the substrate 130*p* to the shield segments 110*p*, 110*p*', thereby increasing the sliding resistance therebetween. Additionally or alternatively, the energy fields (e.g., electromagnetic fields) of the interference elements 170*p* can repel the shield segments 110*p*, 110*p*' away from the substrate 130*p*, thereby reducing the sliding resistance therebetween. It should be appreciated that the interference elements 170*p* also can include permanent magnets (e.g., in the shield segments 110*p*, 110*p*' or in the substrate 130*p*) opposite to electromagnetic elements.

In an embodiment, a controller can control or direct activation or operation of the interference elements 170*p* (e.g., responsive to one or more signals received from one or more sensors, as described above). For example, the one or more sensors positioned and configured to sense an impending application of one or more forces against the protective garment and can send corresponding signals to the controller; responsive to such signals, the controller can control the interference elements 170*p* (e.g., the controller can control orientations and relative polarities of the energy fields) to increase sliding resistance between the substrate 130*p* and the shield segments 110*p*, 110*p*'. Conversely, for example, in the absence of such signals from the sensor(s), the controller can move or direct movement of the interference elements 170*p* such as to reduce or reverse attraction between the substrate 130*p* and shield segments 110*p*, 110*p*', thereby permitting the shield segments 110*p*, 110*p*' to move away from each other.

Figure 15:
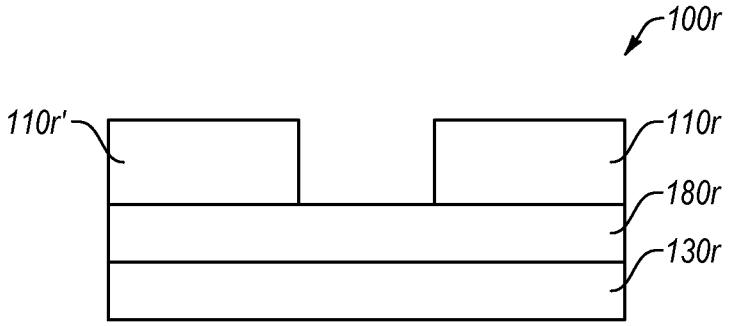

It should be appreciated that, in addition to the elements or components described above, protective garment can include any number of elements or components, such as additional shock or impact absorbing layers. FIG. 15 illustrates a schematic side view of a protective garment 100*r*, according to an embodiment. Except as described herein, the protective garment 100*r* and its elements and components can be similar to or the same as any of the protective garments described herein. For example, the protective garment 100*r* can include shield segments 110*r*, 110*e* that can be similar to or the same as any of the shield segments described herein and can be operably secured or coupled to a substrate 130*r* (e.g., as described above).

In an embodiment, the protective garment 100*r* can include one or more additional layers. For example, the protective garment 100*r* can include an additional impact absorbing layer 180*r*. In the illustrated embodiment, the layer 180*r* can be positioned between the shield segments 110*r*, 110*e* and the substrate 130*r*. Additionally or alternatively, the layer 180*r* can be positioned below the substrate 130*r* (e.g., closer to the skin of the individual wearing the protective garment 100*r*).

Generally, the layer 180*r* can include any number of suitable materials. In an embodiment, the layer 180*r* can include impact absorbing material, such as hard or soft foam. Also, it should be appreciated that the protective garment 100*r* can include any suitable number of layers that can vary from one embodiment to the next. Furthermore, in an embodiment, the protective garment can include one or more elements or components (e.g., one or more layers) that can at least partially enclose the shield segments or the substrate (e.g., to protect the shield segments or activation mechanism for external elements, such as rain, snow, etc.).

Figure 16:
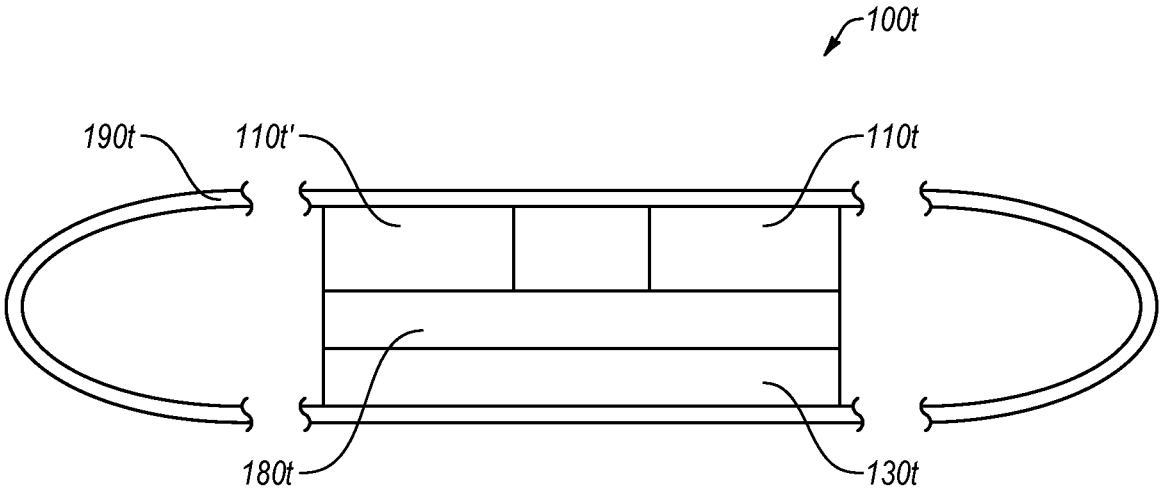

FIG. 16 illustrates a schematic side view of a protective garment 100*t*, according to an embodiment. Except as described herein, the protective garment 100*t* and its elements and components can be similar to or the same as any of the protective garments described herein. For example, the protective garment 100*t* can include shield segments 110*t*, 110*t*' that can be similar to or the same as any of the shield segments described herein and can be operably secured or coupled to a substrate 130*t* (e.g., as described above).

As described above, the protective garment 100*t* can include one or more additional or alternative layers or elements or components, such as layer 180*t* that can be positioned between the shield segments 110*t*, 110*t*' and the substrate 130*t*. In an embodiment, the protective garment 100*t* can include an enclosure 190*t* that can at least partially surround or enclose the shield segments 110*t*, 110*t*' or the substrate 130*t*. For example, the enclosure 190*t* can include one or more water-resistant or waterproof materials (e.g., the enclosure 190*t* can include water-repelling coating, one or more waterproof materials, such as polyethylene, etc., a water-resistant membrane, such as GORTEX, combinations thereof, or other suitable materials), a natural fabric (e.g., cotton, leather, wool, etc.), a synthetic fabric (e.g., nylon, polyester, etc.), or one or more polymers (e.g., a plastic helmet).

Generally, the enclosure 190*t* can be positioned in any manner relative to the remaining elements or components of the protective garment 100*t*. For example, the enclosure 190*t* can be coupled or attached to the substrate 130*t* or to one or more of shield segments 110*t*, 110*t*'. Alternatively, the enclosure 190*t* can be detached from the substrate 130*t* or from the shield segments 110*t*, 110*t*'. According to an embodiment, the enclosure 190*t* can at least partially surround or protect other elements or components of the protective garment 100*t*.

Figure 17:
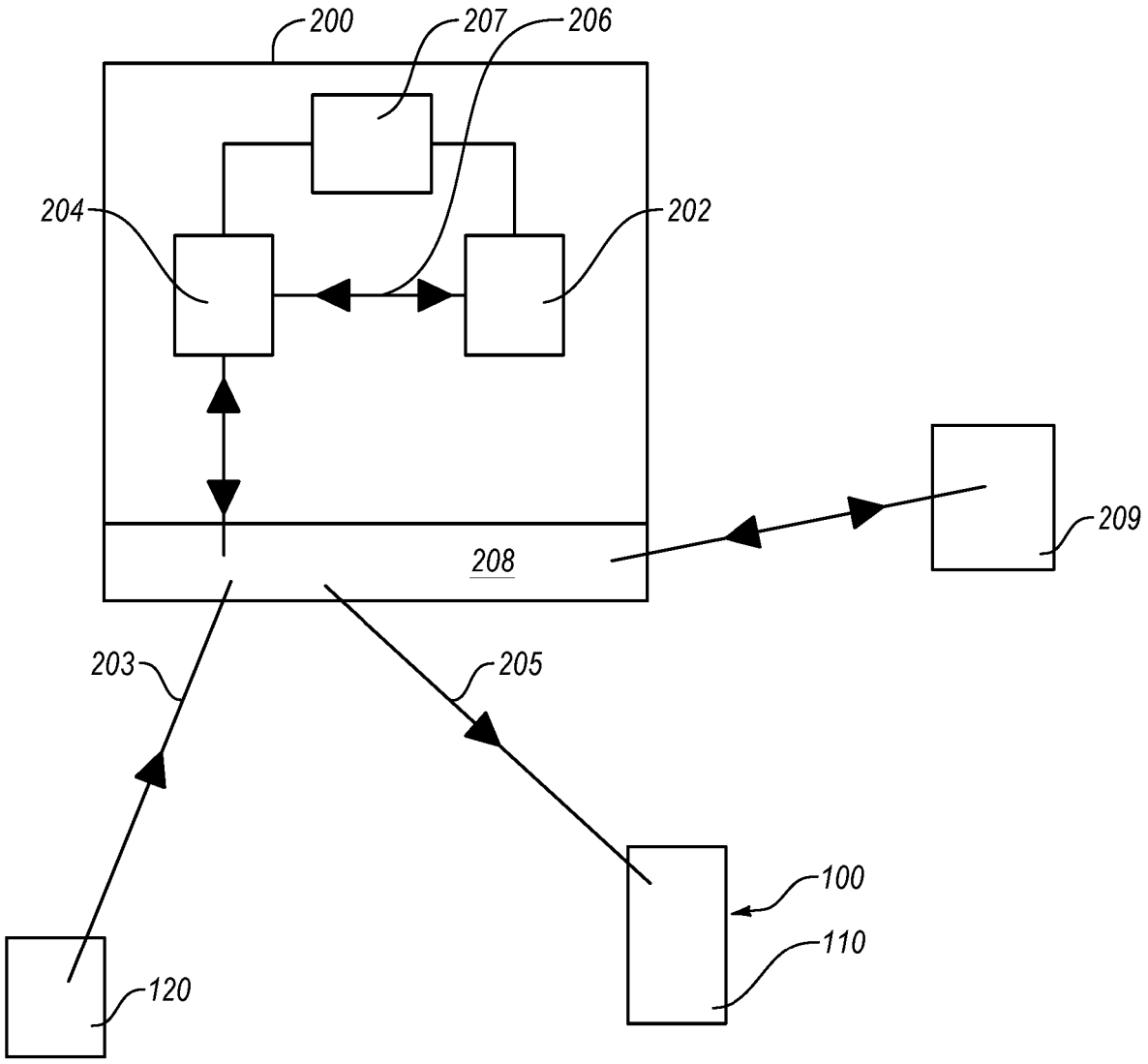
FIG. 17 is a block diagram of a protective garment system including a controller, according to an embodiment.

FIG. 17 is a block diagram of a protective garment system that includes the protective garment 100, at least one sensor 120, and at least one controller 200, according to an embodiment. The controller 200 can include at least one memory storage medium 202 and at least one processor 204, including processing electrical circuitry operably coupled to the at least one memory storage medium 202. The controller can include an interface 208. The controller 200 can be configured to determine if a deployment condition is required for the protective garment 100 based at least partially on the one or more sensors 120 sensing at least one of a potential impact or an actual impact to the individual. The at least one controller 200 can be operably coupled to the activation mechanism(s) of the protective garment 100 and to sensor(s) 120. The at least one controller 200 can control reconfiguring the protective garment 100 from an undeployed configuration to a deployed configuration (and vice versa), as described herein. For example, the protective garment 100 can include multiple shield segments 110, and the controller 200 can control movement or positions of the shield segments 110 responsive to the signals received from the sensors 120.

In an embodiment, the at least one controller 200 can include multiple controllers, each operably coupled to at least some of the one or more sensors 120. For example, a protective garment system can include a plurality of controllers, each operably coupled to one or more sensors 120 and shield segments 110 or activation mechanisms thereof in a distinct region, and each configured to determine if a distinct region (or distinct shield segment 110) is experiencing at least one of an actual or potential impact. Responsive to the determination, each controller 200 can direct the protective garment 100 in the distinct region to deploy the shield segments, effective to move one or more rigid members 210 associated therewith. In an embodiment, each of the plurality of controllers can be configured to communicate with other controllers of the plurality of controllers.

The at least one memory storage medium 202 can include any non-transitory memory storage medium, such as a hard-disk drive, a solid state memory device, a flash drive, or the like. The at least one memory storage medium 202 can include one or more of program instructions for the processor 204, data from the one or more sensors 120 (e.g., present or previous sensed motion characteristics such as potential impacts, actual impacts, or forces associated therewith), threshold values for one or more forces or characteristics sensed by the one or more sensors 120, a history of the protective garment (e.g., deployment of the shield segments, current status of the protective garment system, etc.), look-up tables corresponding to any of the proceeding, or system diagnostic statuses (e.g., current and past statuses, or readiness states of any components of the system).

The at least one processor 204 can be operably coupled to the at least one memory storage medium 202 via the connection 206. The connection 206 can be a wireless connection or a hardwired connection. The at least one processor 204 is configured to access and read the memory storage medium 202. The at least one processor 204 is configured to receive sensor signals or data (e.g., preprocessed or converted signals, such as converted from analog to digital) indicating a potential or actual impact. The at least one processor 204 is configured to direct movement or position of the shield segments 110 of the protective garment 100.

The at least one processor 204 is configured to determine if a deployment (e.g., protection) condition is required based on information from the one or more sensors 120. For example, the one or more sensors 120 can sense one or more objects within a specific proximity of the protective garments system (or individual wearing the same), and the processor 204 can determine if the proximity is below a threshold value for safety. In an embodiment, the one or more sensors 120 can sense a velocity of the one or more objects (e.g., the ground or a car) relative to the individual (or vice versa) or one or more sensors 120, and determine if the velocity is indicative of a potential impact therewith. In an embodiment, the one or more sensors 120 can be configured to sense a force or pressure applied thereto, and the processor 204 can be configured to determine if an actual or potential impact is taking place based on the sensor data. For example, one or more sensors 120 can be configured to sense a pressure applied thereto, and the processor can determine if the pressure is indicative of a force capable of injuring an individual, such as by comparing the measured force to a threshold force stored in the memory. The threshold levels can be set for any condition, such as the amount of pressure applied or potentially applied thereto, the size of object impacting or potentially impacting the garment system, the velocity of object impacting or potentially impacting the garment system, the orientation of one or more portions of the garments system such as twisting, falling, or bending, or combinations thereof. For example, the threshold value can be set by the individual, a medical professional, a manufacturer, the controller, or other persons. For example, the threshold value can be set by an external computing device.

Condition values beyond threshold levels or values indicate the need for deployment conditions. The processor 204 can compare the sensed conditions, such as velocity, pressure, proximity, etc., to one or more threshold values to determine that an actual or potential impact is taking place. Responsive to a sensed characteristic (e.g., force, pressure, velocity, proximity, etc.) being beyond the corresponding threshold value, the processor 204 can direct reconfiguration of the protective garment 100 from the undeployed configuration to the deployed configuration or vice versa. In an embodiment, the at least one processor 204 can be configured to determine if a potential impact or actual impact is taking place based on a combination of any of the sensed characteristics disclosed herein. Responsive to the determination of a required deployment condition (e.g., a change in states), the processor 204 can direct movement or sliding of the shield segments 110 in a manner that reconfigures the protective garment 100 from the undeployed configuration to the deployed configuration or vice versa.

The processor 204 can be configured to determine if a threshold level has been met or exceeded by a differential of one or more sensed characteristics sensed at adjacent sensors of the one or more sensors 120. For example, a single sensor 120 of a plurality of sensors 120 detecting a specific amount of pressure in a specific region of a garment can indicate a puncture wound is likely as compared to the same pressure spread out over a larger surface area. Responsive thereto, the processor 204 can direct the protective garment 100 to reconfigure from undeployed configuration to deployed configuration. In an embodiment, a threshold level can include a level of pressure applied over a surface area whereby the threshold level corresponds to a force indicative of a possible puncture that would result from a relatively sharp object. In an embodiment, from sensor data from the plurality of sensors 120, the processor 204 can determine a level of acceleration or deceleration indicative of a force capable of breaking bone of the individual, or a motion and direction thereof (e.g., twisting or bending) indicative of a force capable of damaging a body part of the individual. Suitable threshold levels can be stored in the memory storage medium 202.

The processor 204 can be configured to set or adjust one or more threshold levels based on one or more of a velocity of at least one body part of the individual, one or more physiological attributes of the individual (e.g., weight, height, age, health, etc.), a location of the individual with respect to one or more objects, a time of day, or an activity level of the individual. That is, the processor 204 can be configured to adjust the threshold levels to compensate for velocity of a person, size of a person wearing the protective garment system, proximity of the individual to adjacent objects, or any other criteria.

In an embodiment, the processor 204 can be configured to search the deployment history of the inflatable members therein and at least partially base deployment determinations thereon. For example, the processor 204 can note a region where multiple impacts have taken place (as determined from multiple deployments) and deploy the shield segments to provide added protection from repetitive injury to the individual in that region.

As discussed above, the controller 200 can include the interface 208. The interface 208 can be configured to communicate with one or more of a user, a computing device, a tablet, a mobile computing device (e.g., smart phone), or a remote control. The interface 208 can include a screen, an input device, transceiver, or relay. For example, the interface 208 can relay sensed information signals 203 from the sensors 120 to the processor 204 or memory storage medium 202, and can relay control signals 205 to the protective garment 100. In an embodiment, the sensed information signals 203 and control signals 205 can be relayed directly between the processor 204 and sensor 120 or between the processor and the protective garment 100. The sensed information or signals 203 and 205 can be transmitted and received via a wireless connection (e.g., Wi-Fi, infrared, Bluetooth, etc.) or a hardwired connection.

In an embodiment, the interface 208 can include or can be connected to a user interface 209 configured to inform a user or the individual of information relating to the system. The user interface 209 can include one or more output devices such as a visual (e.g., a screen), audio (e.g., chime), or haptic indicator (e.g., tactile, vibrating indicators) and one or more input devices (such as a keyboard, buttons, levers, switches, or dials). For example, the one or more output devices can indicate the shield segments are deployed or are being deployed. For example, each shield segment can include lights, dyes, or display that light up when the shield segments are deployed and shut off when the shield segments are not deployed.

The user interface 209 can include a desktop computer, a laptop computer, a tablet computer, a mobile computing device (e.g., smart phone), a watch, or a remote control. The user interface 209 can be configured to output information to the user and accept input from the user. For example, the user interface 209 can be configured to output or communicate to a user (e.g., individual wearing the protective garment 100, medical professional, coach, etc.) one or more of previous impacts against the individual, a deployment history of the shield segments 110, sensed motion characteristics, a readiness status of one or more portions of the protective garment system, program instructions, or threshold levels of force applied to the individual, or direction of the one or more forces applied to the at least one of the plurality of shield segments 110. The interface 208 and user interface 209 can be configured to receive one or more of input, instructions, or programming from one or more of the individual, the user, a mobile computing device (e.g., smart phone), a tablet, or a computing device.

The controller 200 can include a power source 207. The power source 207 can be operably coupled to (e.g., hardwired or wirelessly) one or more of the processor 204, the memory storage medium 202, the interface (including or excluding the user interface), the one or more sensors 120, the plurality of inflatable members 230, or the fluid source 234. The power source 207 can include one or more of a battery, a solar cell, a kinetic energy harvester, or a wall plug. However, in other embodiments, the power source 207 can be external to the controller 200.

As described above, protective garment(s) can protect any number of body regions of an individual, which can vary from one embodiment to the next. FIGS. 18A-18D are respective schematics of protective garments 100*t*, 100*u*, 100*v*, 100*x*, according to one or more embodiments. Except as otherwise described herein, the protective garments 100*t*, 100*u*, 100*v*, 100*x* and their respective elements or components can be similar to or the same as any of the protective garments described herein and their respective elements or components.

Figure 18A:
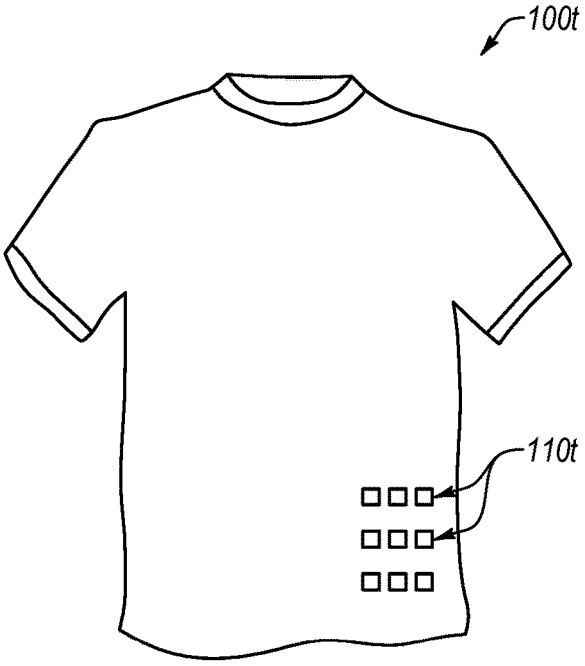
FIGS. 18A-18D are schematics of different garments that can include any of the shield segments disclosed herein, according to different embodiments.

As shown in FIG. 18A, in one or more embodiments, the protective garment 100*t* includes a supportive member configured generally in a form of a shirt or other covering designed to cover at least a portion of a torso, abdomen, shoulders, or arm. The supportive member of the protective garment 100*t* can be configured as a polo shirt, t-shirt, long-sleeved shirt, short sleeved shirt, sleeveless shirt, vest, jersey (e.g., football, baseball, basketball, soccer, hockey, or rugby jersey), sweatshirt, coat, jacket, protective gear (e.g., a rib vest) or any other garment or item (e.g., outerwear, innerwear) that at least partially covers an abdominal region, spinal region, back region, thoracic region, of an individual. In an embodiment, the protective garment 100*t* can include shield segments 110*t* positioned at any number of suitable locations (e.g., near the abdomen portion of the individual, as shown in FIG. 18A). For example, the shield segments 110*t* can be positioned to at least partially protect at least one of the upper right portion (e.g., right hypochondrium), the upper central portion (e.g., epigastrium), upper left portion (e.g., left hypochondrium), the middle right portion (e.g., right lumber region), the middle central portion (e.g., umbilical region), the middle left portion (e.g., left lumber region), bottom right portion (e.g., right iliac fossa), bottom central portion (e.g., hypogastrium), or the bottom left portion (e.g., left iliac fossa) of the abdominal region.

The shield segments 110*t* can be positioned to protect at least one of a spleen, colon (e.g., right colon, sigmoid colon, descending colon), left kidney, right kidney, pancreas, liver, gallbladder, small intestine, large intestine, stomach, duodenum, adrenal glands, umbilicus, jejunum, ileum, appendix, cecum, urinary bladder, female reproductive glands, etc. In an embodiment, the shield segments 110*t* can be positioned to at least partially protect at least one of the right upper quadrant, the left upper quadrant, the right lower quadrant, or the left lower quadrant of the abdominal region. In an embodiment, the shield segments 110*t* can be positioned to at least partially protect a spine of the individual, such as at least one of the cervical spine (e.g., the shirt includes a collar), thoracic spine, lumbar spine, sacral spine, or tailbone. In an embodiment, the shield segments 110*t* can be positioned to at least partially protect a chest of an individual, such as at least one of the true ribs, false ribs, floating ribs, sternum, clavicle, the jugular notch, pectoral region, sternal region, etc. In an embodiment, the shield segments 110*t* can be positioned to at least partially protect a back of the individual, such at least one of lower back, upper back, scapular regions, interscapular region, lumbar region, sacral region, coxal region, inguinal region, gluteal region, etc. In an embodiment, the shield segments 110*t* can be positioned to at least partially provide skeletal support to at least one of the abdominal region, spinal region, back region, thoracic region, or arm of the individual.

In an embodiment, the shield segments 110*t* can be positioned to at least partially protect an arm of the individual, such as at least one of the shoulder, elbow, wrist, forearm, acromial region, brachial region, cubital region, antebrachial region, or another portion of the arm. In embodiments, the protective garment 100*t* can be configured generally in a form of, a sleeve, a shoulder brace, wrist brace, an elbow brace, or other gear or garment for covering a portion or all of an arm. In an embodiment, the shield segments 110*t* can be positioned to at least partially protect at least a portion of a hand of the individual, such as at least one of carpal region, palmar region, finger, or another portion of the hand. In embodiments, the protective garment 100*t* can comprise or be configured generally in a form of a glove, a finger cot, or other gear or garment for covering a portion or all of a hand.

Figure 18B:
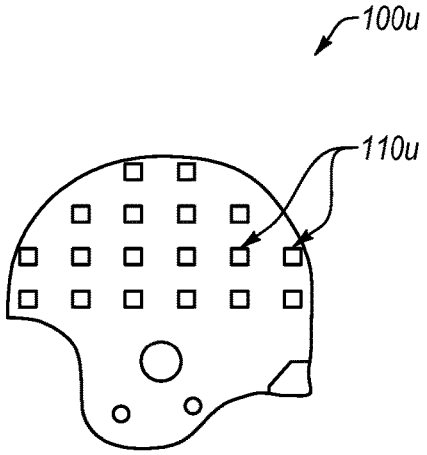

FIG. 18B is a schematic of the protective garment 100*u* including a supportive member that is configured in the shape of a head-cover that includes shield segments 110*u*, according to an embodiment. The protective garment 100*u* can be configured as a baseball cap, football helmet, motocross helmet, safety helmet, scrum cap, bicycle helmet, hockey helmet, face mask, chin guard, mouth guard, glasses, or any other garment that at least partially covers a portion of an individual's head. Generally, the shield segments 110*u* can be positioned at any suitable portion(s) of the protective garment 100*u*. For example, the shield segments 110*u* can be positioned to at least partially protect at least one of eyes, ears, nose, mouth, teeth, tongue, chin, jaw, cheek, facial region, cranial region, cervical region, nuchal region, forehead, temple, crown, nape of the neck, occipital protuberance, parietal ridge, side, top, or another portion of the head. In an embodiment, the shield segments 110*u* can be positioned to at least partially provide skeletal support to at least one of the head of the individual.

Figure 18C:
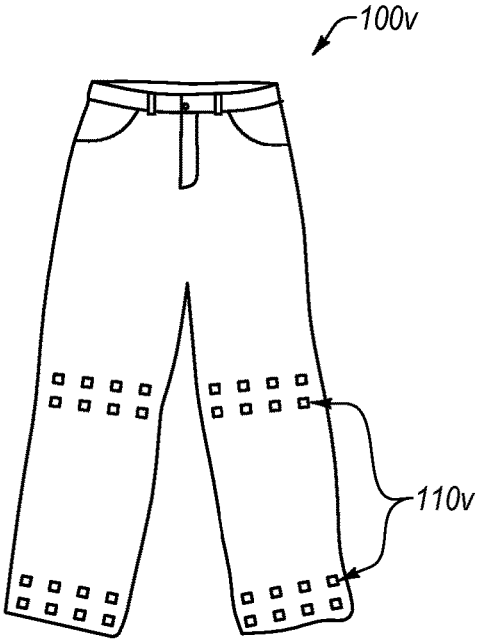

FIG. 18C is a schematic of the protective garment 100*v* including a supportive member that is configured in the shape of pants that includes shield segments 110*v*, according to an embodiment. The supportive member of the protective garment 100*v* can be configured as pants or similar garments or gear of any suitable length generally designed to cover at least a portion of each of two legs, or other garment or gear generally designed to cover at least a portion of at least one leg, or other garment or gear generally designed to cover at least a portion of a pelvis. For example, the protective garment can comprise full length trousers, shorts (e.g., basketball shorts), capri pants, skirts, dresses, kilts, jeans, leggings, football pants, baseball knickers, hockey pants, rugby trousers, knee brace, ankle brace, jockstrap, boxer briefs, or any other garment (e.g., outerwear, innerwear) that at least partially covers at least a portion of at least one of a leg or a pelvic region of an individual. For example, the protective garment 100*v* can at least partially protect at least one of an ankle, calf, shin, knee, thigh, male reproductive organs, female reproductive organs, lower abdominal region (e.g., iliac fossa), waist, rectal region, pubic region, coxal region, inguinal region, gluteal region, sacral region, lower lumbar region, perineal region, popliteal region, calcaneal region, crural region, tarsal region, dorsum of foot, patellar region, etc. The protective garment 100*v* can be configured as footwear (not shown), such as a sock, shoes, sandals, slippers, or any other item that covers at least a portion of a foot. For example, the protective garment 100*v* can at least partially protect at least one of a toe, arch, or heel. In an embodiment, the protective garment 100*v* be positioned to at least partially provide skeletal support to at least one of the feet, legs, or pelvic region of the individual.

In an embodiment, the protective garment 100 includes a supportive member that can be configured generally in a form of a single unit of clothing (not illustrated) that substantially covers at least the majority of the torso or the majority of a body of the individual 102. For example, the supportive member can be a jumpsuit, a flight suit, a unitard, a wetsuit, an undergarment (e.g., a union suit), etc. For example, the single unit of clothing can cover all of a limb (e.g., have long sleeves or long pant legs) or a portion of the limb (e.g., have short sleeves or short pant legs). In an embodiment, an undergarment can be worn under additional protective gear, such as protective athletic gear, protective safety gear (e.g., fire protection) or protective environmental gear (e.g., SCUBA gear or a space suit).

In an embodiment, the protective garment 100 can be configured to be worn by a nonhuman animal. For example, the protective garment 100 can be configured to be worn by a rescue animal, such as a dog, or military animal, such as a dog or horse. For example, the protective garment 100 might be configured to cover a torso, a pelvis, a shoulder, a leg, a paw or hoof, a head, a neck, or a spine of an animal. For example, the protective garment 100 might be configured as a vest, a helmet, a neck cover, or a cover for a paw or leg.

Figure 18D:
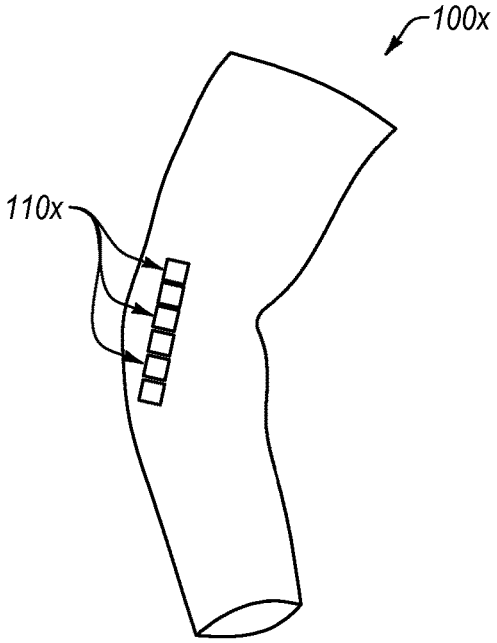

FIG. 18D is a schematic of the protective garment 100*x* including a supportive member that is configured in the shape of a sleeve that includes shield segments 110*x*, according to an embodiment. The supportive member of the protective garment 100*x* can be any item of clothing configured to protect only a single limb of an individual. As such, the shield segments 110*x* can be positioned to at least partially protect at least one of a wrist, hand, elbow, shoulder, knee, ankle, calf, shin, or another suitable body part. In an embodiment, the shield segments 110*x* can be positioned to at least partially provide skeletal support to the individual.

Figure 19A:
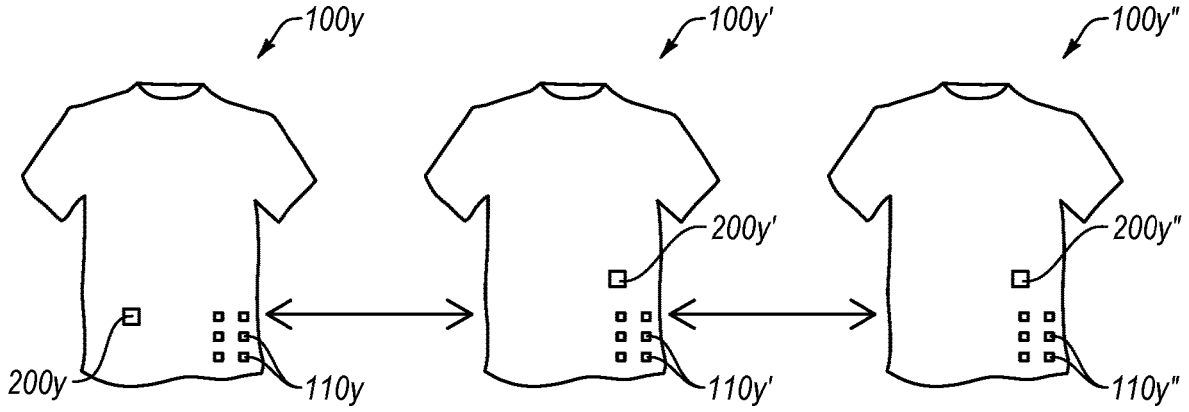
FIG. 19A is a schematic illustration of system that includes a plurality of garments, according to an embodiment.

In an embodiment, a system can include multiple protective garments operably coupled to one or more controllers. FIG. 19A is a schematic of a system that includes a plurality of protective garments 100*y*, 100*y*', 100*y*", according to an embodiment. Any of the protective garments 100*y*, 100*y*', 100*y*" and their respective elements and components can be similar to or the same as any of the protective garments described herein and their corresponding elements and components. For example, each of the protective garments 100*y*, 100*y*', 100*y*" can include respective shield segments 110*y*, 110*y*', 110*y*" positioned at any number of suitable locations.

In an embodiment, the protective garments 100*y*, 100*y*', 100*y*" are communicably coupled together. For example, each of the protective garments 100*y*, 100*y*', 100*y*" can include a corresponding controller 200*y*, 200*y*;' 200*y*" that can control operation thereof or receive signals from one or more sensors (not shown). The controllers 200*y*, 200*y*', 200*y*" can be operably coupled together or in communication with one another. For example, the controllers 200*y*, 200*y*', 200*y*" transmit information or data to one another (e.g., data or signals from one or more sensors, data or signals related to one or more control signals, such as control signals to reconfigure one or more of the protective garments 100*y*, 100*y*', 100*y*", etc.). In an embodiment, at least one of the protective garments 100*y*, 100*y*', 100*y*" (e.g., one or more of the controllers 200*y*, 200*y*', 200*y*") can include a communication device (e.g., at least one of a receiver or transmitter) that can be integrated with or operably coupled to the corresponding controller of the controllers 200*y*, 200*y*', 200*y*" or can be standalone (e.g., operably to one or more sensors on or near the protected garment).

The protective garments 100*y*, 100*y*', 100*y*" that are communicably coupled together can transmit any number of suitable signals to each other. The signals can include, for example, at least one of location, speed, direction of movement, or acceleration of at least one of the protective garments 100*y*, 100*y*', 100*y*", and the operation of the protective garments 100*y*, 100*y*', 100*y*" can be controlled responsive to receiving the signals. For example, the signals can include one or more sensing signals, one or more operational instructions, one or more control signals, one or more programs, information from a database, etc. In an embodiment, the protective garments 100*y*, 100*y*', 100*y*" can be worn by multiple individuals (e.g., the protective garments 100*y*, 100*y*', 100*y*" can be configured as shirts that can be worn by multiple individuals). Additionally or alternatively, the protective garments 100*y*, 100*y*', 100*y*" can be worn by the same individual (e.g., multiple garments that can protect corresponding body regions of the individual).

Figure 19B:
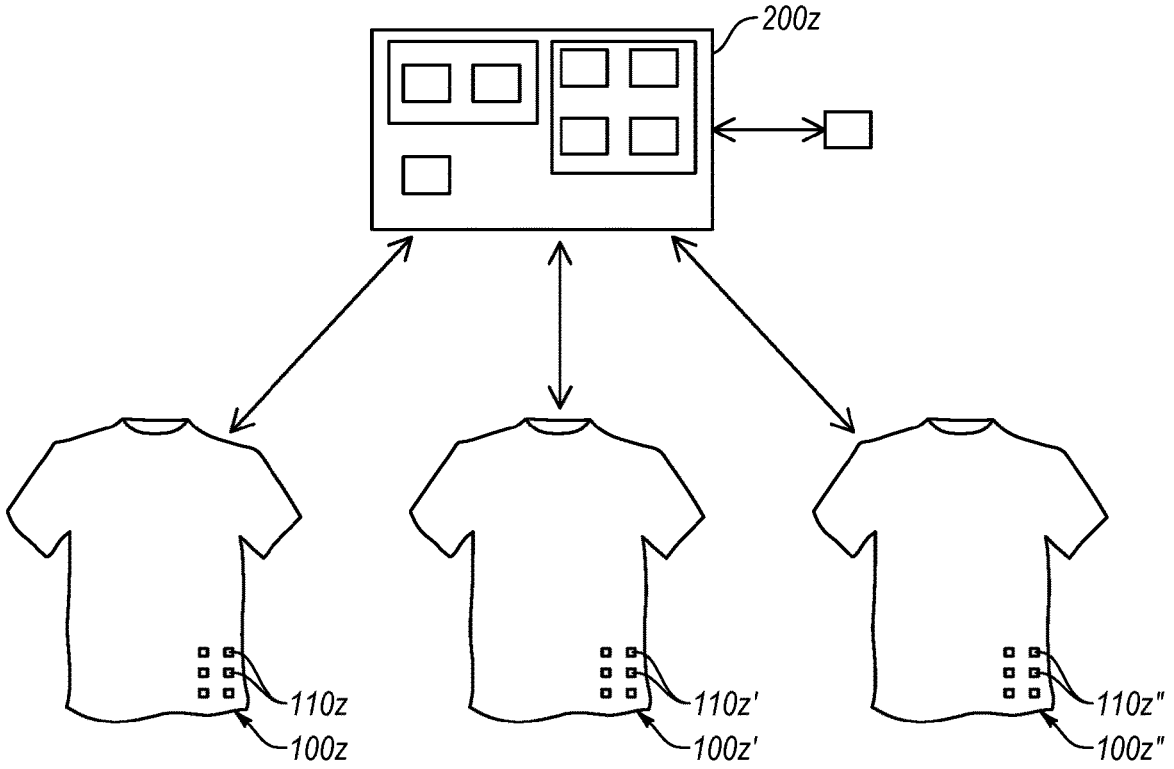
FIG. 19B is a schematic of a system that includes a plurality of garments, according to an embodiment.

In an embodiment, multiple protective garments can be connected to the same controller. FIG. 19B is a schematic of a system that includes a plurality of protective garments 100*z*, 100*z*', 100*z*", according to an embodiment. Any of the protective garments 100*z*, 100*z*', 100*z*" and their respective elements and components can be similar to or the same as any of the protective garments described herein and their corresponding elements and components. For example, each of the protective garments 100*z*, 100*z*', 100*z*" can include respective shield segments 110*z*, 110*z*', 110*z*" positioned at any number of suitable locations.

In an embodiment, the protective garments 100*z*, 100*z*', 100*z*" can be operably coupled to a controller 200*z* (e.g., the controller 200*z* can be similar to or the same as the controller 200 (FIG. 17)). For example, the protective garments 100*z*, 100*z*', 100*z*" can be in wireless communication with the controller 200*z*. For example, the controller 200*z* can be configured to at least partially control the operation of the protective garments 100*z*, 100*z*', 100*z*", as described above. For example, the controller 200*z* can be embodied as a central computing unit (CCU). The CCU can be communicably coupled to the protective garments 100*z*, 100*z*', 100*z*". The CCU can include at least one of a laptop, desktop computing device, tablet, mobile computing device (e.g., smart phone), remote control, or another suitable electronic device.

In an embodiment, the controller 200*z* can be configured to output information (e.g., at a user interface) about one or more previous impacts at any of the protective garments 100*z*, 100*z*', 100*z*" or individuals wearing any of the protective garments 100*z*, 100*z*', 100*z*". Additionally or alternatively, the controller 200*z* can be configured to output information related to movement of any of the shield segments 110*z*, 110*z*', 110*z*". In an embodiment, the controller 200*z* can be configured to output information related to operation or failure of any of the protective garments 100*z*, 100*z*', 100*z*".

In an embodiment, the controller 200*z* can be configured to output one or more recommendations related to safety of an individual wearing at least one of the protective garments 100*z*, 100*z*', 100*z*" (e.g., whether the individual should be moved to a safe location, removed from an athletic event, requires medical attention, etc.). The one or more recommendations can be based at least partially on meeting or exceeding one or more threshold level (e.g., levels related to impact energy imparted onto the individual, number of impacts, alerts received from the individual, etc.). The threshold level can be correlated to a selected likelihood that an individual wearing at least one of the protective garments 100*z*, 100*z*', 100*z*" has been injured from one or more impacts. The controller 200*z* can determine that at least one threshold level has been met or exceeded based on one or more signals received from the sensors.

In an embodiment, the threshold level (e.g., an injury threshold level) can be a selected likelihood that an actual impact punctured an individual wearing at least one of the protective garments 100*z*, 100*z*', 100*z*". For example, the threshold level can be determined based on at least the force of the impact and the radius of curvature of the impact source. In an embodiment, the threshold level can be a likelihood that an actual impact broke or fractured a bone of an individual wearing at least one of the protective garments 100*z*, 100*z*', 100*z*". For example, the threshold level can be determined based on at least a location on the individual that is impacted and a force applied to the location. In an embodiment, the threshold level can be a likelihood that an actual impact damaged a body part (e.g., ruptured spleen, concussion, fractured a joint, contusion, etc.) of an individual wearing at least one of the protective garments 100*z*, 100*z*', 100*z*". For example, the threshold level can be determined based on at least a location on the individual that is impacted and a force applied to the location. In an embodiment, the threshold level can include a deployment threshold level that indicates when the controller 200*z* directs shield segments to deploy (e.g., when the force of an impact will exceed a force threshold level).

The controller 200*z* can be configured to set or adjust one or more threshold levels based at least partially on one or more of a velocity of at least one body part of the individual, one or more physiological attributes of the individual (e.g., weight, height, age, health, etc.), a location of the individual within an area (e.g., if the individual is within a playing field), a location of the individual with respect to one or more objects, a time of day, an elapsed time (e.g., the time the individual has been playing or if the individual has been playing for a pre-determined amount of time), a history of impacts to at least a portion of the garment or protective member (e.g., a portion housing the sensor sensing current conditions), a history of deployment of the protective member (e.g., to the same portion housing the sensor sensing current conditions), a velocity of the individual (e.g., how fast is a football player running), or an activity level of the individual. That is, the processor 219 can be configured to adjust the threshold levels to compensate for velocity of a person, size of a person wearing the protective garment system, proximity of the individual to adjacent objects, or any other criteria.

The threshold level can be when an actual impact has a likelihood of less than 1%, 1%, 2%, 3%, 4%, 5%, 10%, 15%, 20%, 25%, 30%, 35%, 40%, 45%, 50%, 60%, 70%, 75%, 80%, 90%, 95%, or about 100% of causing an injury, including ranges between any of the percentages. In an embodiment, threshold level is predetermined and is stored on a memory storage medium (e.g., memory storage medium 202 in FIG. 17) of the controller 200*z*. In an embodiment, the threshold level is determined based on information stored on the memory storage medium. For example, the threshold level can be determined at least partially based on an individual's medical history. In an embodiment, the threshold level can vary. For example, an impact that can a severe injury to an individual can have a lower threshold level (e.g., lower likelihood of injury) than an impact that can cause a minor injury. In another example, the threshold level may vary based on a time of day, an activity of an individual wearing at least one of the protective garments 100*z*, 100*z*', 100*z*", etc.

In an embodiment, the at least one controller of the garments 100*z*, 100*z*', 100*z*" can be configured to determine whether the threshold level has been met or exceeded at least partially based on one or more sensed information signals received by the controller. The garments 100*z*, 100*z*', 100*z*" can include a user interface configured to alert the individual or another entity when the threshold level has been met or exceeded. For example, the device can include a speaker that emits a sound when the threshold level has been met or exceeded. In such an embodiment, the controller 200*z* can be omitted.

Furthermore, in an embodiment, any of the controllers or sensors can transmit information or data to one or more data storage devices or systems that can be associated with or can include medical records (e.g., medical records of the individual wearing the protective garment(s)). For example, the controller can store or transmit data related to the number and severity of impacts received by an individual (e.g., impact force imparted onto the individual, impact energy absorbed by the individual, location(s) of impact(s), etc.). In an embodiment, the medical records of the individual can be associated with or can receive information related to the impact(s) to assess effects of the impact(s) on the health of the individual, to assess whether the individual may need to seek medical attention, etc.

It will be understood that a wide range of hardware, software, firmware, or virtually any combination thereof can be used in the controllers described herein. In one embodiment, several portions of the subject matter described herein can be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more programs running on one or more processors (e.g., as one or more programs running on one or more microprocessors), as firmware, or as virtually any combination thereof. In addition, the reader will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution.

In a general sense, the various embodiments described herein can be implemented, individually and/or collectively, by various types of electro-mechanical systems having a wide range of electrical components such as hardware, software, firmware, or virtually any combination thereof; and a wide range of components that can impart mechanical force or motion such as rigid bodies, spring or torsional bodies, hydraulics, and electro-magnetically actuated devices, or virtually any combination thereof. Consequently, as used herein "electro-mechanical system" includes, but is not limited to, electrical circuitry operably coupled with a transducer (e.g., an actuator, a motor, a piezoelectric crystal, etc.), electrical circuitry having at least one discrete electrical circuit, electrical circuitry having at least one integrated circuit, electrical circuitry having at least one application specific integrated circuit, or a microprocessor configured by a computer program which at least partially carries out processes and/or devices described herein), electrical circuitry forming a memory device (e.g., forms of random access memory), electrical circuitry forming a communications device (e.g., a modem, communications switch, or optical-electrical equipment), and any non-electrical analog thereto, such as optical or other analogs.

In a general sense, the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). The subject matter described herein can be implemented in an analog or digital fashion or some combination thereof.

The herein described components (e.g., steps), devices, and objects and the discussion accompanying them are used as examples for the sake of conceptual clarity. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, the reader can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

In some instances, one or more components can be referred to herein as "configured to." The reader will recognize that "configured to" or "adapted to" are synonymous and can generally encompass active-state components and/or inactive-state components and/or standby-state components, unless context requires otherwise.

While particular aspects of the present subject matter described herein have been shown and described, it will be apparent that, based upon the teachings herein, changes and modifications can be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood that if a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense the convention (e.g., "a system having at least one of A, B, or C" would include but not be limited to systems that have A alone, B alone, C alone, A and B together, A and C together, B and C together, and/or A, B, and C together, etc.). Virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, any recited operations therein can generally be performed in any order. Examples of such alternate orderings can include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, the various aspects and embodiments disclosed herein are for purposes of illustration and are not intended to be limiting, with the true scope and spirit being indicated by the following claims.

What is claimed is:

1. A protective garment system, comprising:

at least one surface that is at least one of conformed or conformable to one or more body regions of an individual and is at least partially defined by a substrate;

a plurality of shield segments positioned adjacent to the at least one surface; and a plurality of resilient members, at least one of the plurality of shield segments being secured to the substrate by two or more of the plurality of resilient members near the at least one surface, at least one of the two or more resilient members configured to, elastically extend to enable the at least one of the plurality of shield segments to move from a first position to a second position responsive to one or more forces applied thereto; and contract to return the at least one of the plurality of shield segments from the second position to the first position.

2. The protective garment system of claim 1, wherein the at least one of the two or more resilient members is configured to elastically extend to enable the at least one of the plurality of shield segments to slide from the first position to the second position responsive to one or more forces applied thereto.

3. The protective garment system of claim 1, wherein at least one of the one or more forces is generated by an impact.

4. The protective garment system of claim 1, wherein, at the first position, the at least one of the plurality of shield segments is spaced from at least one adjacent one of the plurality of shield segments.

5. The protective garment system of claim 4, wherein, at the second position, the at least one of the plurality of shield segments forms a substantially continuous shield layer.

6. The protective garment system of claim 4, wherein the plurality of shield segments include two or more segments having complementary shapes.

7. The protective garment system of claim 4, further including one or more locking elements configured to selectively secure the at least one of the plurality of shield segments in the second position.

8. The protective garment system of claim 4, wherein, in the second position, the at least one of the plurality of shield segments is positioned over the at least one adjacent one of the plurality of shield segments.

9. The protective garment system of claim 4, wherein the one or more forces includes an external impact force, and movement of the at least one of the plurality of shield segments from the first position to the second position at least one of deflects or redirects the one or more forces.

10. The protective garment system of claim 4, wherein the one or more forces are external to the protective garment, and movement of the at least one of the plurality of shield segments from the first position to the second position distributes the one or more forces among two or more of the plurality of shield segments.

11. The protective garment system of claim 4, wherein the one or more forces are internal to the protective garment.

12. The protective garment system of claim 1, wherein, at the second position, the at least one of the plurality of shield segments is spaced from at least one adjacent shield segment of the plurality of shield segments, and at the first position the at least one of the plurality of shield segments forms a substantially continuous shield layer.

13. The protective garment system of claim 12, further including one or more locking elements configured to selectively secure the at least one of the plurality of shield segments in the second position.

14. The protective garment system of claim 13, wherein the one or more locking elements include one or more latches pivotable between a locking position and an open position, in the locking position, the one or more latches secure corresponding ones of the plurality of shield segments in the second position and, in the open position, the one or more latches allow the plurality of shield segments to move from the second position to the first position.

15. The protective garment system of claim 13, further including one or more sensors positioned and configured to sense at least one of a potential application of the one or more forces or an actual application of the one or more forces.

16. The protective garment system of claim 15, further including:

at least one controller including control electrical circuitry; and wherein the one or more sensors are operably coupled to the control electrical circuitry of the controller.

17. The protective garment system of claim 16, wherein the one or more locking elements are configured to release corresponding ones of the plurality of shield segments.

18. The protective garment system of claim 17, wherein:

the one or more locking elements are configured to release corresponding ones of the plurality of shield segments responsive to a control signal received from the control electrical circuitry; and the control electrical circuitry is configured to send the control signal to the one or more locking elements responsive to one or more signals received from the one or more sensors.

19. The protective garment system of claim 12, further including one or more locking elements configured to secure together at least two adjacent shield segments of the plurality of shield segments in the first position.

20. The protective garment system of claim 1, wherein the at least one of the two or more resilient members includes at least one of at least one spring, at least one elastic member, or an elastic fabric.

21. The protective garment system of claim 1, further including one or more sensors positioned and configured to sense at least one of a potential application of the one or more forces or an actual application of the one or more forces.

22. The protective garment system of claim 21, further including:

a controller including control electrical circuitry; and wherein the one or more sensors are operably coupled to the control electrical circuitry of the controller.

23. The protective garment system of claim 22, wherein the controller includes memory and the control electrical circuitry is configured to store data that includes at least one of number of times the one or more forces were applied to the at least one of the plurality of shield segments, magnitude of the one or more forces applied to the at least one of the plurality of shield segments, direction of the one or more forces applied to the at least one of the plurality of shield segments, one or more of previous impacts against the individual, a deployment history of the plurality of shield segments, one or more sensed motion characteristics of the individual, a readiness status of one or more portions of the protective garment, or threshold levels of force applied to the individual.

24. A protective garment system, comprising:

at least one surface that is at least one of conformed or conformable to one or more body regions of an individual;

a plurality of shield segments positioned adjacent to the at least one surface;

at least one resilient member that secures at least one of the plurality of shield segments near the at least one surface, the at least one resilient member configured to:

elastically extend to enable the at least one of the plurality of shield segments to move from a first position to a second position responsive to one or more forces applied thereto; and contract to return the at least one of the plurality of shield segments from the second position to the first position; and one or more locking elements configured to selectively secure the at least one of the plurality of shield segments in at least one of the first position or the second position, wherein, at the second position, the at least one of the plurality of shield segments is spaced from at least one adjacent shield segment of the plurality of shield segments, and at the first position the at least one of the plurality of shield segments forms a substantially continuous shield layer.

25. The protective garment system of claim 24, wherein the one or more locking elements include one or more latches pivotable between a locking position and an open position, in the locking position, the one or more latches secure corresponding ones of the plurality of shield segments in the second position and, in the open position, the one or more latches allow the plurality of shield segments to move from the second position to the first position.

26. The protective garment system of claim 24, wherein the one or more locking elements are configured to at least secure together at least two adjacent shield segments of the plurality of shield segments in the first position.

27. The protective garment system of claim 26, further including one or more sensors positioned and configured to sense at least one of a potential application of the one or more forces or an actual application of the one or more forces.

28. The protective garment system of claim 27, further including:

at least one controller including control electrical circuitry; and wherein the one or more sensors are operably coupled to the control electrical circuitry of the controller.

29. The protective garment system of claim 28, wherein the one or more locking elements are configured to release corresponding ones of the plurality of shield segments.

30. The protective garment system of claim 29, wherein:

the one or more locking elements are configured to release corresponding ones of the plurality of shield segments responsive to a control signal received from the control electrical circuitry; and the control electrical circuitry is configured to send the control signal to the one or more locking elements responsive to one or more signals received from the one or more sensors.

31. The protective garment system of claim 24, further including:

a substrate that at least partially defines the at least one surface;

wherein the at least one resilient member includes a plurality of resilient members;

wherein the at least one of the plurality of shield segments is secured to the substrate by two or more of the plurality of resilient members.

32. A protective garment system, comprising:

at least one surface that is at least one of conformed or conformable to one or more body regions of an individual;

a plurality of shield segments positioned adjacent to the at least one surface;

at least one resilient member that secures at least one of the plurality of shield segments near the at least one surface, the at least one resilient member configured to:

elastically extend to enable the at least one of the plurality of shield segments to move from a first position to a second position responsive to one or more forces applied thereto; and contract to return the at least one of the plurality of shield segments from the second position to the first position; and one or more locking elements configured to selectively secure the at least one of the plurality of shield segments in at least one of the first position or the second position, wherein, at the first position, the at least one of the plurality of shield segments is spaced from at least one adjacent one of the plurality of shield segments.

33. The protective garment system of claim 32, wherein the one or more locking elements include one or more latches pivotable between a locking position and an open position, in the locking position, the one or more latches secure corresponding ones of the plurality of shield segments in the second position and, in the open position, the one or more latches allow the plurality of shield segments to move from the second position to the first position.

34. The protective garment system of claim 32, wherein the one or more locking elements are configured to at least secure at least two adjacent shield segments of the plurality of shield segments in the first position.

35. The protective garment system of claim 34, further including one or more sensors positioned and configured to sense at least one of a potential application of the one or more forces or an actual application of the one or more forces.

36. The protective garment system of claim 35, further including:

at least one controller including control electrical circuitry; and wherein the one or more sensors are operably coupled to the control electrical circuitry of the controller.

37. The protective garment system of claim 36, wherein the one or more locking elements are configured to release corresponding ones of the plurality of shield segments.

38. The protective garment system of claim 37, wherein:

the one or more locking elements are configured to release corresponding ones of the plurality of shield segments responsive to a control signal received from the control electrical circuitry; and the control electrical circuitry is configured to send the control signal to the one or more locking elements responsive to one or more signals received from the one or more sensors.

39. The protective garment system of claim 32, further including:

a substrate that at least partially defines the at least one surface;

wherein the at least one resilient member includes a plurality of resilient members;

wherein the at least one of the plurality of shield segments is secured to the substrate by two or more of the plurality of resilient members.

* * * * *